US005686044A

United States Patent [19]

Ikegami et al.

[11] Patent Number: 5,686,044

[45] Date of Patent: Nov. 11, 1997

[54] AUSTENITIC STAINLESS STEELS FOR PRESS FORMING

[75] Inventors: Yuji Ikegami; Qinzhong Zhang, both of Kanagawa, Japan

[73] Assignee: Nippon Yakin Kogyo Co., Ltd., Tokyo, Japan

[21] Appl. No.: 621,247

[22] Filed: Mar. 25, 1996

[30] Foreign Application Priority Data

| | | | |
|---|---|---|---|
| Mar. 31, 1995 | [JP] | Japan | 7-075411 |
| Mar. 31, 1995 | [JP] | Japan | 7-075412 |
| Mar. 31, 1995 | [JP] | Japan | 7-075413 |
| Mar. 31, 1995 | [JP] | Japan | 7-075414 |
| Jun. 30, 1995 | [JP] | Japan | 7-153120 |
| Jun. 30, 1995 | [JP] | Japan | 7-164960 |

[51] Int. Cl.[6] ..... C22C 38/42; C22C 38/44; C22C 38/06

[52] U.S. Cl. ..... 420/49; 420/58; 420/61

[58] Field of Search ..... 420/49, 58, 61

[56] References Cited

U.S. PATENT DOCUMENTS 3,376,780 4/1968 Tancyzn .

FOREIGN PATENT DOCUMENTS 51-29854 8/1976 Japan .
140102 8/1989 Japan .
3169405 7/1991 Japan .
4-66651 3/1992 Japan .
4-72038 3/1992 Japan .
6287635 10/1994 Japan .

OTHER PUBLICATIONS

Patent Abstract of Japan, vol. 94, No. 0010, Oct. 11, 1996.
Patent Abstract of Japan, vol. 16, No. 273 (C–0953), Jun. 18, 1992.
Patent Abstract of Japan, vol. 16, No. 277 (C–0954), Jun. 22, 1992.
European Search Report and Annex, May 14, 1996.
English Language Abstract of JP–B–51–29854, Aug. 27, 1976.
English Language Abstract of JP–B–1–40102, Aug. 25, 1989.
English Language Abstract of JP–A–3–169405, Jul. 23, 1991.

*Primary Examiner*—Deborah Yee
*Attorney, Agent, or Firm*—Greenblum & Bernstein P.L.C.

[57] ABSTRACT

An austenitic stainless steel for press forming has considerably excellent deep drawability and bulging property as compared with those of the conventional one, which comprises C: 0.01–0.10 wt %, Si: not more than 1.0 wt %, Mn: not more than 3.0 wt %, Ni: 6.0–10.0 wt %, Cr: 15.0–19.0 wt %, Cu: 1.0–4.0 wt %, Al: 0.2–2.5 wt %, N: not more than 0.05 wt %, and if necessary, Mo: 0.03–3.0 wt % and B: 0.0010–0.020 wt %, and is adjusted to satisfy anyone of Ni equivalent: 21.0–23.0, crystal grain size number (N) of not less than 8, cleanness of 0.020%, low Si content and (C+N) amount ≧0.04.

15 Claims, 10 Drawing Sheets

AUSTENITIC STAINLESS STEELS FOR PRESS FORMING

BACKGROUND OF THE INVENTION

1. Field of the Invention

This invention relates to austenitic stainless steels for press forming having excellent a super-deep drawability, good bulging property, excellent resistance to season cracking and grinding property.

2. Description of Related Art

As an austenitic stainless steel for severe deep-drawing, there have been SUS 301, SUS 304 and the like. These stainless steels form strain induced martensite through cold working to exhibit a remarkable work hardening. Therefore, they are considerably excellent in the bulging property at the press forming, but there is a problem that a product left after the deep drawing work creates cracks or so-called season cracking.

For example, in JP-B-51-29854 are proposed austenitic stainless steels, in which a work hardenability is improved by adding adequate amounts of Si, Mn and Cu and further a susceptibility to season cracking is dulled by restricting a sum of solid-soluted carbon amount and solid-soluted nitrogen amount to less than 0.04 wt %, for solving the above problem.

Furthermore, JP-B-1-40102 proposes austenitic stainless steels having a very excellent deep drawability by adding Al and Cu together and decreasing Si content to further improve the deep drawability, a chemical composition of which comprises C: not more than 0.05 wt %, Si: less than 0.5 wt %, Mn: not more than 3.0 wt %, Cr: 15.0–19.0 wt %, Ni: 6.0–9.0 wt %, Cu: not more than 3.0 wt %, Al: 0.5–3.0 wt % and the remainder being substantially iron.

Moreover, such austenitic stainless steels for press forming are used even in the fields of building materials, sinks and the like. Such steels are required to have such qualities that the surface unevenness is less, and the good gloss and the high image definition as the surface properties are possessed and the polishability required for mirror finishing is good.

In this respect, the conventional austenitic stainless steel for mirror finish must be used after being subjected to a mirror finishing treatment, so that the bearing under such a treatment (mirror polishing finish through lapping or underground polishing before the treatment) becomes large. In order to mitigate the bearing under the treatment, it is indispensable to decrease the crystal grain size of steel (see JP-A-3-169405). However, as the crystal grain size of steel becomes smaller, there is caused a problem of degrading the press formability, i.e. the deep drawability or bulging property.

However, when the stainless steel having the improved press formability as disclosed in JP-B-1-40102 is subjected to a severer press forming for a complicated shape, the deep drawability and bulging property are insufficient, while in the stainless steel disclosed in JP-B-51-29854, the sum of solid-soluted C and solid-soluted N is less than 0.04 wt % and hence the season cracking is excellent but the deep drawability itself is poor at this level. Therefore, when the complicated and severer press forming is carried out in these conventional techniques, there is a problem that an intermediate heating treatment is indispensable.

Under the above situations, it is, recently and strongly, demanded to develop austenitic stainless steels having excellent property capable of being subjected to press forming into various shapes or so-called the deep drawability and bulging property without requiring the intermediate heating treatment from a view point of economic reasons and surface properties.

SUMMARY OF THE INVENTION

It is, therefore, an object of the invention to provide austenitic stainless steels for press forming having considerably improved the resistance to season cracking, deep drawability and bulging property as compared with those of the conventionally known austenitic stainless steels, particularly a stainless steel described in JP-B-51-29854.

The inventors have made various studies with respect to the influence of chemical composition in the austenitic stainless steel upon the resistance to season cracking, the deep drawability and bulging property thereof and developed austenitic stainless steels capable of attaining to the above object.

A first aspect of the invention is based on a knowledge that the Mo content considerably improves the resistance to season cracking through a synergistic action with the co-existence of Al and Cu, and the effect of Al exerting on the deep drawability and resistance to season cracking is more developed by restricting N amount.

(1) The invention lies in an austenitic stainless steel for press forming comprising C: 0.01–0.10 wt %, Si: not more than 1.0 wt %, Mn: not more than 3.0 wt %, Ni: 6.0–10.0 wt %, Cr: 15.0–19.0 wt %, Mo: 0.03–3.0 wt %, Cu: 1.0–4.0 wt %, Al: 0.2–2.5 wt %, N: not more than 0.05 wt % and the balance being iron and inevitable impurities.

(2) In order to improve the hot workability, the stainless steel of the above chemical composition (1) is effective to include B: 0.0010–0.020 wt %.

A second aspect of the invention is based on a knowledge that the deep drawability and bulging property of the austenitic stainless steel are improved when C+N amount and Ni amount are controlled properly and is an invention developed by adding Mo to more improve the corrosion resistance and adding B to improve the hot workability.

(3) The invention developed under the above knowledge lies in an austenitic stainless steel for press forming comprising C: 0.03–0.10 wt %, Si: 0.5–1.0 wt %, Mn: not more than 3.0 wt %, Ni: 6.0–10.0 wt %, Cr: 15.0–19.0 wt %, Cu: 1.0–4.0 wt %, Al: 0.45–2.0 wt %, N: not more than 0.05 wt % and the balance being iron and inevitable impurities, in which C and N satisfy $C+N \geqq 0.04$ wt % and Ni equivalent (wt %) represented by the following equation is within a range of not less than 21 but less than 22.8.

$$\text{Ni equivalent (wt \%)} = 12.6(C+N)+0.35Si+1.05Mn+Ni+0.65Cr+0.6Cu-0.4Al$$

(4) The stainless steel of the above chemical composition (3) further contains Mo: 0.05–3.0 wt %.

(5) The stainless steel of the composition (3) or (4) contains B: 0.0010–0.020 wt %.

In the stainless steels of the above (3)–(5), it is preferable to have a chemical composition that C: 0.04–0.08 wt %, Al: 0.5–1.5 wt %, N: less than 0.025 wt %, particularly less than 0.020 wt % and Ni equivalent range of 21—not more than 22.7.

A third aspect of the invention is an invention based on a knowledge that both the deep drawability and bulging property are improved by adding Al and Cu together to the meta-stable austenitic stainless steel and controlling C and Ni equivalent.

(6) The invention developed under the above knowledge lies in an austenitic stainless steel for press forming comprising C: 0.03–0.10 wt %, Si: less than 0.5 wt %, Mn: not more than 3.0 wt %, Ni: 6.0–10.0 wt %, Cr: 15.0–19.0 wt %, Cu: 1.0–4.0 wt %, Al: 0.5–2.0 wt %, N: not more than 0.05 wt % and the balance being iron and inevitable impurities, in which Ni equivalent (wt %) represented by the following equation is within a range of 21.0–23.0.

$$\text{Ni equivalent (wt \%)}=12.6(C+N)+0.35Si+1.05Mn+Ni+0.65Cr+0.6Cu-0.4Al$$

(7) The stainless steel of the above chemical composition (6) further contains Mo: 0.05–3.0 wt %.

(8) The stainless steel of the composition (6) or (7) contains B: 0.0010–0.020 wt %.

In the stainless steels of the above (6)–(8), it is preferable to have a chemical composition that C: exceeding 0.05 but 0.10 wt %.

A fourth aspect of the invention is an invention based on a knowledge that both the deep drawability and bulging property are improved by adding small amounts of Al and Cu together to the meta-stable austenitic stainless steel and controlling C and Ni equivalent.

(9) The invention developed under the above knowledge lies in an austenitic stainless steel for press forming comprising C: 0.03–0.10 wt %, Si: less than 0.5 wt %, Mn: not more than 3.0 wt %, Ni: 6.0–10.0 wt %, Cr: 15.0–19.0 wt %, Cu: 1.0–4.0 wt %, Al: 0.2–less than 0.5 wt %, N: not more than 0.05 wt % and the balance being iron and inevitable impurities, in which Ni equivalent (wt %) represented by the following equation is within a range of 21.0–23.0.

$$\text{Ni equivalent (wt \%)}=12.6(C+N)+0.35Si+1.05Mn+Ni+0.65Cr+0.6Cu-0.4Al$$

(10) The stainless steel of the above chemical composition (9) further contains Mo: 0.05–3.0 wt %.

(11) The stainless steel of the composition (9) or (10) contains B: 0.0010–0.020 wt %.

In the stainless steels of the above (9)–(11), it is preferable to have a chemical composition that C: 0.04–0.10 wt % and Ni equivalent=21.0–23.0.

A fifth aspect of the invention is an invention wherein two conflicting properties of press formability and grinding property are simultaneously established by adding Al and Cu together to the meta-stable austenitic stainless steel and taking a proper C and Ni equivalent and a delicate balance of a crystal grain size.

(12) The invention lies in an austenitic stainless steel for press forming comprising C: 0.01–0.10 wt %, Si: not more than 1.0 wt %, Mn: not more than 3.0 wt %, Ni: 6.0–10.0 wt %, Cr: 15.0–19.0 wt %, Cu: 1.0–4.0 wt %, Al: 0.2–2.5 wt %, N: not more than 0.05 wt % and the balance being iron and inevitable impurities, in which Ni equivalent represented by the following equation is adjusted to a range of 21.0–22.5 and a crystal grain size number (N) is not less than 8.

$$\text{Ni equivalent (wt \%)}=12.6(C+N)+0.35Si+1.05Mn+Ni+0.65Cr+0.6Cu-0.4Al$$

(13) The stainless steel of the above chemical composition (12) further contains Mo: 0.05–3.0 wt %, whereby the corrosion resistance is improved in addition to the grinding property and press formability.

(14) The stainless steel of the composition (12) or (13) contains B: 0.0010–0.020 wt %, whereby the hot workability is improved in addition to the grinding property and press formability.

A sixth aspect of the invention is based on a knowledge that it is effective to enhance a cleanness by adding small amounts of Al and Cu together to the meta-stable austenitic stainless steel and restricting C and Ni equivalent to a given range and extremely suppressing incorporation of O, S as an inevitable impurity. The invention is based on the above knowledge.

(15) The invention is an austenitic stainless steel for press forming comprising C: 0.01–0.10 wt %, Si: not more than 1.0 wt %, Mn: not more than 3.0 wt %, Ni: 6.0–10.0 wt %, Cr: 15.0–19.0 wt %, Cu: 1.0–4.0 wt %, Al: 0.2–2.5 wt %, N: not more than 0.05 wt %, O: controlled to not more than 20 ppm, S: controlled to not more than 20 ppm, and the remainder being substantially Fe, in which Ni equivalent represented by the following equation is within a range of 21.0–23.0 and a cleanness is not more than 0.020%.

$$\text{Ni equivalent (wt \%)}=12.6(C+N)+0.35Si+1.05Mn+Ni+0.65Cr+0.6Cu-0.4Al$$

(16) The stainless steel of the above chemical composition (15) having a high cleanness according to the invention contains Mo: 0.03–3.0 wt %.

(17) The stainless steel of the composition (15) or (16) having a high cleanness contains B: 0.0010–0.020 wt %.

DESCRIPTION OF THE PREFERRED EMBODIMENTS

Figure 1:
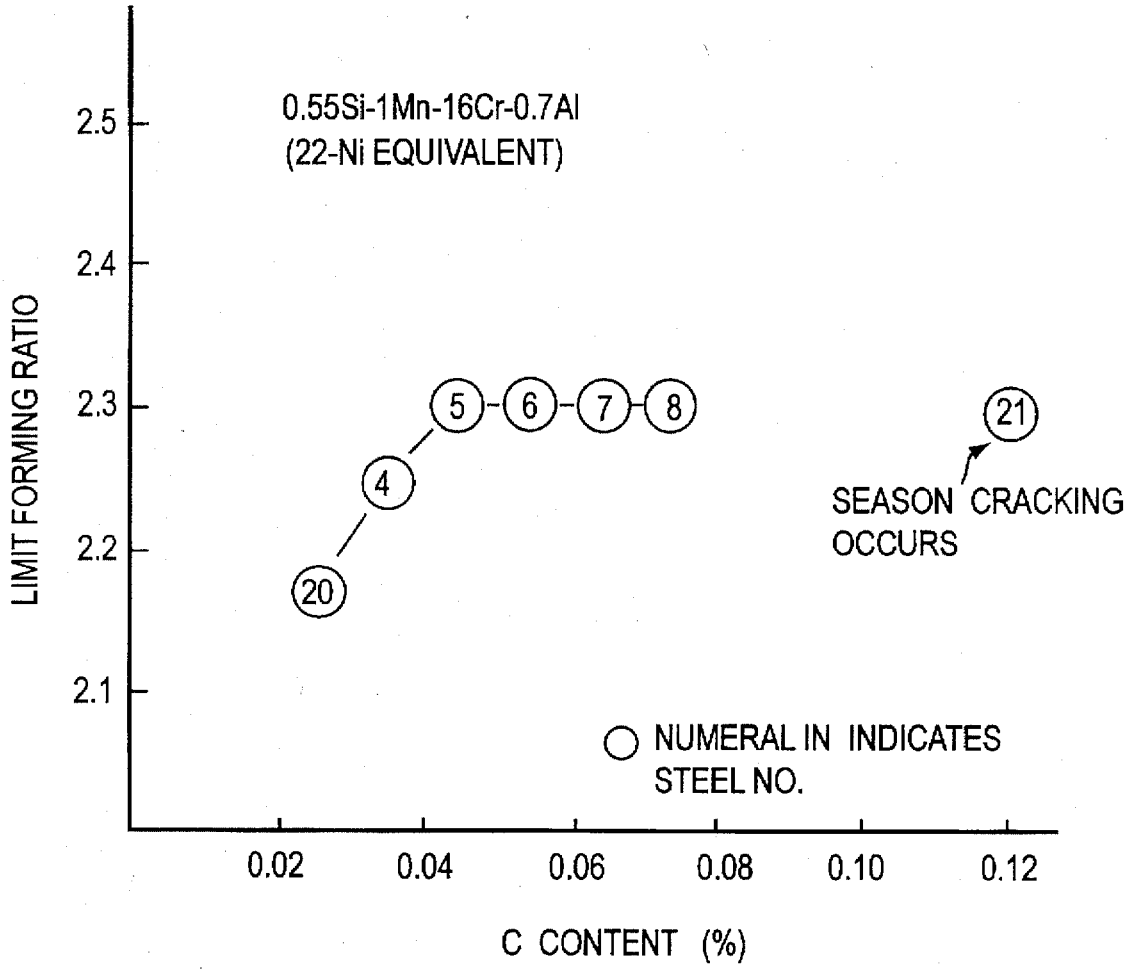
FIG. 1 is a graph showing a relation between C content and limit drawing ratio in Example 3.

The reason why the chemical composition according to the invention is limited to the above range is as follows:

C: 0.01–0.10 wt %

C is an element strongly forming austenite and is very effective for reinforcing austenite phase and strain induced martensite phase and also is a necessary component for improving the deep drawability and bulging property, so that it is necessary that the C content is at least 0.01 wt %, preferably 0.03 wt %, particularly 0.04 wt %, and more particularly more than 0.05 wt %. However, when it exceeds 0.10 wt %, the susceptibility to season cracking and susceptibility to grain boundary corrosion are enhanced, so that the upper limit is 0.10 wt %, preferably up to 0.08 wt %.

Si: not more than 1.0 wt %

Si is an effective deoxidizing agent and is an inevitable component at a steel-making step. As the content becomes larger, the work hardenability of austenite phase itself is enhanced. Particularly, it is an element effective for enhancing the bulging property in the composition system containing Al and Cu and is added in an amount of not more than 1.0 wt %. Because, when the Si content exceeds 1.0 wt %, δ-ferrite is formed to damage the hot workability, whereby hot cracking is caused and the season cracking is apt to be caused.

However, if the Si content exceeds 0.5 wt % even in the above range, there is observed a tendency that the season cracking is apt to be caused, so that the control of Si content to a lower level as described in the steels of the third and fourth aspects is an effective means.

Mn: not more than 3.0 wt %

Mn serves as a deoxidizing and desulfurizing agent and is an element contributing to the stabilization of austenite phase, so that it is required to be preferably not less than 0.1 wt %. However, when it exceeds 3.0 wt %, the austenite phase becomes too stable and hence the deep drawability is degraded, so that it is restricted to not more than 3.0 wt %.

Ni: 6.0–10.0 wt %

When the Ni content is less than 6.0 wt %, δ-ferrite is formed to bring about the degradation of hot workability, while when it exceeds 10.0 wt %, it is difficult to form martensite phase during the press forming, so that it is restricted to a range of 6.0–10.0 wt %.

Cr: 15.0–19.0 wt %

When the Cr content is less than 15.0 wt %, the corrosion resistance is insufficient, while when it exceeds 19.0 wt %, δ-ferrite is formed to degrade the hot workability, so that it is restricted to a range of 15.0–19.0 wt %.

Mo: 0.03–3.0 wt %

Mo is generally well-known as an element improving the corrosion resistance of the stainless steel and has an effect for considerably improving the resistance to season cracking by the synergistic action with the co-existence of Cu and Al in the invention. That is, the addition of Mo, Cu and Al together considerably improves the resistance to season cracking in the austenitic stainless steel, so that it is not required to excessively control the C content, which has hitherto been considered to be harmful in the resistance to season cracking, and rather C can positively be utilized for improvement of the deep drawability. Therefore, Mo is an inevitable element in the construction of the invention.

In order to improve the corrosion resistance and the resistance to season cracking, it is required to add Mo in an amount of at least 0.03 wt %, while when it exceeds 3.0 wt %, a great amount of δ-ferrite is formed to degrade the hot workability and deep drawability. Moreover, if it is intended to improve only the corrosion resistance, it is enough to add Mo in an amount of 0.05–3.0 wt %. The Mo content is preferably within a range of not less than 0.1 wt %, more particularly a range of 0.1–1.0 wt %.

Further, the effect of improving the resistance to season cracking by Mo and the like is saturated when it exceeds 1.0 wt %, which becomes disadvantageous in the economical reason and hence the upper limit is preferably not more than 1.0 wt % considering the economical reason.

Cu: 1.0–4.0 wt %

Cu is an element considerably improving the deep drawability of the austenitic stainless steel. The improving effect is poor when the Cu content is less than 1.0 wt %. On the other hand, when it exceeds 4.0 wt %, the hot workability is obstructed, so that the Cu content is restricted to a range of 1.0–4.0 wt %. It is preferably within a range of 1.0–3.0 wt %, more particularly 1.5–3.0 wt %.

Al: 0.2–2.5 wt %

Al is an element contributing to an improvement of deep drawability together with Cu. When the Al content is less than 0.2 wt %, the improvement of deep drawability is not observed and the susceptibility to season cracking is further enhanced. On the other hand, when it exceeds 2.5 wt %, δ-ferrite is formed to degrade the hot workability and deep drawability. Therefore, it is restricted to a range of 0.2–2.5 wt %. Moreover, the preferable range for improving the deep drawability and resistance to season cracking together is 0.45–2.0 wt %, more particularly 0.5–1.0 wt %.

If it is intended to improve the bulging property in addition to the above properties as in the steels of the fourth aspect, the Al content is restricted to a range of 0.2 wt % but less than 0.5 wt %, whereby the formation of Al nitride and Al oxide is suppressed to improve the deep drawability and bulging property.

N: not more than 0.05 wt %

N is an element forming austenite and is effective to improve the corrosion resistance. In the Al-containing system, if the N content exceeds 0.05 wt %, a great amount of AlN is precipitated to degrade the resistance to season cracking and deep drawability, so that N content is limited to not more than 0.05 wt %, preferably less than 0.025 wt %. Particularly, it is preferably less than 0.020 wt %.

O: not more than 20 ppm

O is a main factor forming non-metallic inclusion in steel and is required to be reduced for controlling the cleanness to a low level. The austenitic stainless steel usually contains 30–50 ppm of O. Since it is required to decrease the inclusion by the suppression of O for conducting severe press forming, the O content is not more than 20 ppm.

S: not more than 20 ppm

In general, S forms MnS, which is an inclusion extending in the rolling direction in cold rolled sheet. When the S content exceeds 20 ppm, the amount of MnS increases and the size thereof becomes large to form a breaking point in the press forming, so that the S content is limited to not more than 20 ppm.

B: 0.0010–0.020 wt %

B is a very effective element for improving the hot workability in Cu and Al containing steel. When the B content is less than 0.0010 wt %, the effect is poor, while when it exceeds 0.020 wt %, the corrosion resistance is degraded. Therefore, the B content is limited to a range of 0.0010–0.020 wt %.

In the steel according to the invention, the control of total content of C and N is an effective means for simultaneously improving the deep drawability and bulging property in addition to the above chemical composition.

That is, both of C and N reinforce martensite phase produced in the press forming at a solid solution state to considerably improve the deep drawability and bulging property. In the invention, therefore, a sum of solid soluted C content and solid soluted N content is not less than 0.04 wt %. Preferably, the lower limit of the total content is 0.05 wt %.

In the invention, it is effective to control Ni equivalent (wt %) represented by the following equation as another means for improving the deep drawability, bulging property and grinding property.

The Ni equivalent is an indicator of strain induced martensite transformation. As the Ni equivalent becomes high, the austenite phase becomes stable. When the Ni equivalent is less than 21 wt %, the martensite phase is formed at a state of solid solution heat treatment to degrade the deep drawability and bulging property. On the other hand, when the Ni equivalent exceeds 23.0 wt %, the quantity of strain induced martensite formed becomes less and the super-deep drawability is not obtained. Therefore, the Ni equivalent is required to adjust to a range of 21.0–less than 23.0 wt %, preferably 21.0–22.7 (wt %), more particularly 21.0–22.5 (wt %).

$$\text{corrected Ni equivalent (wt \%)}=12.6(C+N)+0.35Si+1.05Mn+Ni+0.65Cr+0.98Mo+0.6Cu-0.4Al$$

Moreover, the above Ni equivalent equation according to the invention is an equation arranged by the inventors when a relative quantity of martensite in a test specimen subjected to 30% elongation in tensile test is measured by means of a ferrite scope and added as Cu and Al items to Hirayama's Ni equivalent equation being an indication of austenite stability.

Crystal grain size (N): not less than 8

In general, it is necessary to render the surface roughness of ground starting material (Rmax) into not more than 4 μm in order to mitigate loading at the grinding step for mirror surface. On the other hand, the crystal grain size must be decreased for reducing the surface roughness of the ground starting material (Rmax: not more than 4 μm) as previously mentioned.

Figure 10:
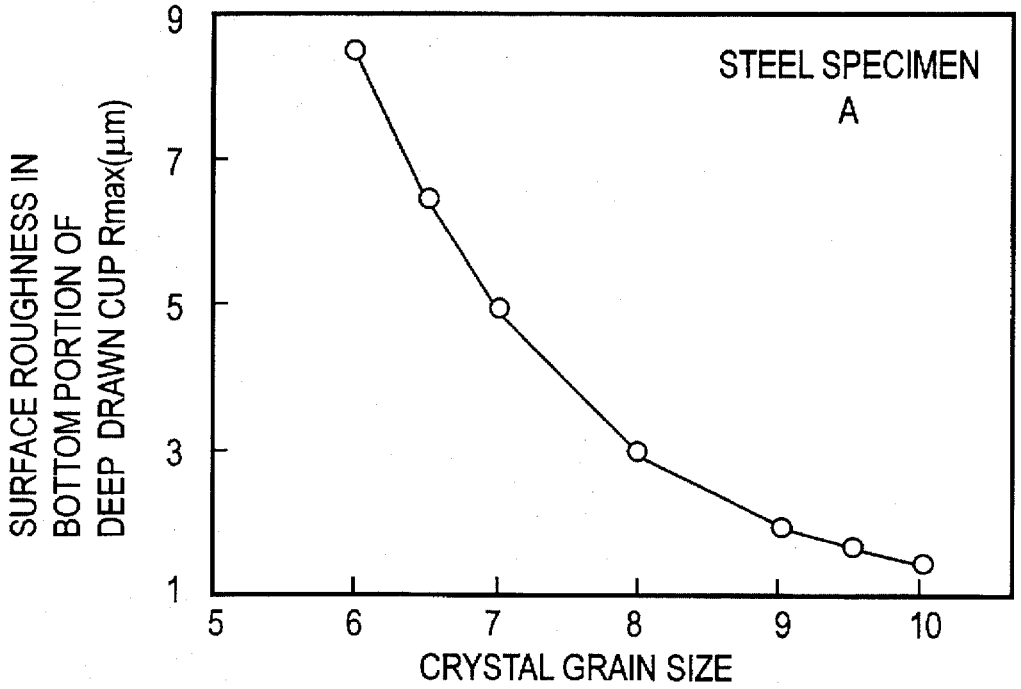
FIG. 10 is a graph showing a relation between crystal grain size and surface roughness of formed product in the fifth aspect of the invention.

FIG. 10 shows a relation between the crystal grain size (N) and the surface roughness (Rmax) of deep drawn cup bottom, from which it is apparent that the surface roughness of the shaped article becomes as small as the crystal grain size becomes small. That is, when the crystal grain size number (N) defined in JIS G0551 is less than 8.0, the surface roughening of the press formed article becomes large and the grinding property is considerably poor. In the invention, therefore, the crystal grain size number (N) is necessary to be not less than 8.0.

Figure 11:
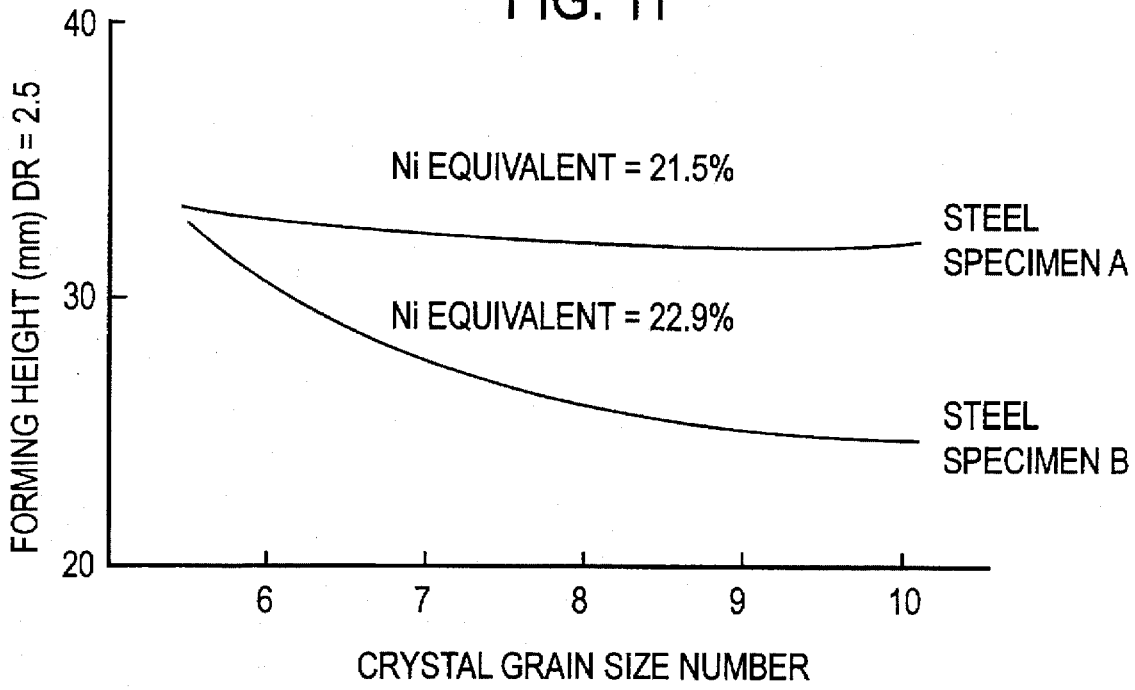
FIG. 11 is a graph showing a relation between crystal grain size number and height of formed product in the fifth aspect of the invention.

However, the austenitic stainless steel generally tends to degrade the deep drawability as the crystal grain size number (N) becomes large or the crystal grain size becomes small. As shown in FIG. 11, in order to hold the formability at a region that the crystal grain size number (N) is not less than 8.0, the composition range should be limited to the range defined in the invention and also the Ni equivalent must be restricted to a certain range.

Moreover, the upper limit of the crystal grain size number (N) is not particularly limited, but the range obtained by the solid solution heat treatment is not more than 11.0.

In the invention, the crystal grain size number (N) of the steel having the above chemical composition is rendered into not less than 8 by mainly adjusting the rolling reduction and conditions of heat treatment. For example, the given crystal grain size number may be obtained by controlling the cold rolling reduction to not less than 40% and conducting the annealing of cold rolled sheet under conditions that the heating is carried out at a temperature of 1000°–1100° C. for 10–30 seconds and the cooling is carried out at a cooling rate faster than air cooling rate (air cooling or water cooling).

Cleanness d: not more than 0.020%

In steel, various inclusions are formed due to the presence of inevitable impurities. As the amount of oxide or sulfide becomes particularly large among these inclusions, it is a point of causing crack in the press forming and hence the deep drawability and bulging property aiming at the invention can not be expected to a given level.

In the invention, therefore, the above problem resulted from the oxide or sulfide inclusion is eliminated by controlling the cleanness d represented by the following equation to not more than 0.020%.

$$d=\{n/(p\times f)\}\times 100$$

wherein p: total lattice number on a glass plate in a field f: number of fields n: number of lattice points occupied by total inclusions in fields f As mentioned above, according to the invention, it is understood that austenitic stainless steels having the excellent deep drawability and bulging property and improved the resistance to season cracking, grinding property, hot workability and the like are obtained by adding Al and Cu together to the meta-stable austenitic stainless steel and strictly controlling Si and Mo or C+N amount and further controlling the crystal grain size number (N), cleanness (d) or Ni equivalent.

EXAMPLES

Example 1

Austenitic stainless steels having a chemical composition as shown in Table 1 (invention steel) and Table 2 (comparative steel) are prepared and subjected to usual hot rolling and cold rolling to a final thickness of 1.0 mm, which are then subjected to an annealing at 1100° C. for 30 seconds.

The thus annealed sheet is subjected to a cylindrical deep drawing test through a flat bottom punch of 40 mm in diameter. The deep drawability is evaluated at a stage that a limit drawing ratio (LDR) is not less than 2.20 or less than 2.20, while the resistance to season cracking is evaluated by the presence or absence of cracking after the drawn cup prepared at the drawing ratio of 2.20 is left to stand at room temperature for 100 hours. Further, the bulging property is evaluated by an Erichsen test. These evaluated results are also shown in Tables 1 and 2.

TABLE 1

| | (Wt %) | | | | | | | | | | | | | Season | Erichsen | |
|---|---|---|---|---|---|---|---|---|---|---|---|---|---|---|---|---|
| Steel No. | C | Si | Mn | P | S | Ni | Cr | Mo | Cu | Al | N | B | LDR | cracking | value (mm) | Remarks |
| A1 | 0.045 | 0.30 | 1.10 | 0.025 | 0.005 | 8.21 | 16.55 | 0.22 | 2.65 | 0.65 | 0.20 | — | ○ | ○ | 13.2 | First |
| A2 | 0.060 | 0.31 | 1.18 | 0.024 | 0.005 | 7.85 | 16.25 | 0.18 | 2.71 | 0.60 | 0.021 | — | ○ | ○ | 13.3 | invention steel |
| A3 | 0.049 | 0.33 | 1.19 | 0.025 | 0.005 | 7.88 | 16.32 | 0.55 | 2.08 | 0.35 | 0.032 | — | ○ | ○ | 13.0 | |
| A4 | 0.030 | 0.32 | 1.23 | 0.025 | 0.005 | 7.60 | 16.25 | 0.21 | 2.80 | 0.55 | 0.025 | 0.0140 | ○ | ○ | 13.5 | Second |
| A5 | 0.045 | 0.28 | 1.18 | 0.025 | 0.005 | 7.62 | 16.25 | 0.20 | 2.75 | 0.58 | 0.009 | 0.0040 | ○ | ○ | 13.5 | invention steel |
| A6 | 0.012 | 0.30 | 1.20 | 0.025 | 0.005 | 8.02 | 16.25 | 0.20 | 2.50 | 0.58 | 0.009 | — | ○ | ○ | 13.0 | First |

TABLE 1-continued

| Steel No. | C | Si | Mn | P | S | Ni | Cr | Mo | Cu | Al | N | B | LDR | Season cracking | Erichsen value (mm) | Remarks |
|---|---|---|---|---|---|---|---|---|---|---|---|---|---|---|---|---|
| | (Wt %) | | | | | | | | | | | | | | | |
| A7 | 0.075 | 0.28 | 1.18 | 0.025 | 0.005 | 7.62 | 15.28 | 0.20 | 2.75 | 0.60 | 0.009 | — | ○ | ○ | 13.3 | invention steel |
| A8 | 0.045 | 0.06 | 1.18 | 0.025 | 0.005 | 7.62 | 16.25 | 0.20 | 3.00 | 0.58 | 0.009 | — | ○ | ○ | 13.4 | |
| A9 | 0.045 | 0.095 | 1.18 | 0.025 | 0.005 | 7.62 | 16.25 | 0.20 | 2.75 | 0.58 | 0.009 | — | ○ | ○ | 13.3 | |
| A10 | 0.045 | 0.28 | 0.13 | 0.025 | 0.005 | 8.62 | 16.25 | 0.20 | 2.75 | 0.58 | 0.009 | — | ○ | ○ | 13.4 | |
| A11 | 0.045 | 0.28 | 2.87 | 0.025 | 0.005 | 5.62 | 16.25 | 0.20 | 2.75 | 0.58 | 0.009 | — | ○ | ○ | 13.4 | |
| A12 | 0.045 | 0.28 | 1.18 | 0.025 | 0.005 | 7.62 | 16.25 | 0.035 | 2.75 | 0.58 | 0.009 | — | ○ | ○ | 13.2 | |
| A13 | 0.045 | 0.28 | 1.18 | 0.025 | 0.005 | 7.62 | 15.20 | 0.97 | 2.75 | 0.58 | 0.009 | — | ○ | ○ | 13.5 | |
| A14 | 0.045 | 0.28 | 1.07 | 0.025 | 0.005 | 6.23 | 15.20 | 2.75 | 2.50 | 0.58 | 0.009 | — | ○ | ○ | 13.3 | |
| A15 | 0.045 | 0.28 | 1.18 | 0.025 | 0.005 | 7.62 | 16.25 | 0.20 | 2.75 | 0.25 | 0.009 | — | ○ | ○ | 13.0 | |
| A16 | 0.045 | 0.28 | 1.18 | 0.025 | 0.005 | 7.62 | 16.25 | 0.20 | 2.75 | 0.90 | 0.009 | — | ○ | ○ | 13.2 | |
| A17 | 0.045 | 0.28 | 1.18 | 0.025 | 0.005 | 7.62 | 17.20 | 0.30 | 7.75 | 2.30 | 0.009 | — | ○ | ○ | 13.0 | |
| A18 | 0.045 | 0.28 | 1.18 | 0.025 | 0.005 | 8.02 | 16.55 | 0.50 | 1.20 | 0.58 | 0.009 | — | ○ | ○ | 13.3 | |
| A19 | 0.045 | 0.28 | 1.18 | 0.025 | 0.005 | 7.02 | 16.25 | 0.20 | 3.80 | 0.70 | 0.009 | — | ○ | ○ | 13.2 | |

Note 1) LDR
○: LDR of not less than 2.20,
×: LDR of less than 2.20
Note 2) Season cracking
○: No season cracking at drawing ratio of 2.20,
×: Occurrence of season cracking,
—: Working impossible at drawing ratio of 2.20

TABLE 2

| Steel No. | C | Si | Mn | P | S | Ni | Cr | Mo | Cu | Al | N | B | LDR | Season cracking | Erichsen value (mm) | Remarks |
|---|---|---|---|---|---|---|---|---|---|---|---|---|---|---|---|---|
| | (Wt %) | | | | | | | | | | | | | | | |
| C1 | 0.044 | 0.28 | 1.19 | 0.025 | 0.005 | 7.80 | 16.75 | 0.01 | 1.99 | 0.65 | 0.035 | — | ○ | × | 13.0 | Comparative Steel |
| C2 | 0.045 | 1.45 | 1.90 | 0.026 | 0.005 | 8.15 | 16.25 | 0.25 | 2.10 | 0.40 | 0.020 | — | ○ | × | 12.9 | |
| C3 | 0.045 | 0.30 | 1.25 | 0.025 | 0.005 | 7.88 | 16.50 | 0.20 | 2.50 | 0.70 | 0.070 | — | × | — | 12.7 | |
| C4 | 0.051 | 0.51 | 1.24 | 0.205 | 0.005 | 8.28 | 18.25 | 0.01 | 0.03 | — | 0.055 | — | × | — | 12.8 | |
| C5 | 0.040 | 0.65 | 1.20 | 0.024 | 0.005 | 6.40 | 17.25 | 0.01 | 2.45 | — | 0.040 | — | × | — | 13.2 | |
| C6 | 0.150 | 0.30 | 1.10 | 0.029 | 0.004 | 7.10 | 16.70 | 0.25 | 2.10 | 0.65 | 0.015 | — | ○ | × | 13.2 | |
| C7 | 0.045 | 0.32 | 1.19 | 0.026 | 0.005 | 10.5 | 18.20 | 0.25 | 2.51 | 0.66 | 0.020 | — | × | — | 12.7 | |
| C8 | 0.045 | 0.31 | 1.18 | 0.026 | 0.005 | 8.10 | 15.50 | 3.10 | 2.51 | 0.55 | 0.010 | — | × | — | 11.5 | |
| C9 | 0.044 | 0.35 | 1.20 | 0.025 | 0.005 | 8.10 | 19.80 | 0.18 | 2.60 | 0.70 | 0.021 | — | × | — | 12.2 | |
| C10 | 0.008 | 0.30 | 1.20 | 0.025 | 0.005 | 7.50 | 16.30 | 0.02 | 2.80 | 0.55 | 0.009 | — | × | — | 12.2 | |
| C11 | 0.045 | 0.30 | 3.20 | 0.025 | 0.005 | 7.50 | 16.30 | 0.20 | 2.80 | 0.55 | 0.009 | — | × | — | 12.0 | |
| C12 | 0.045 | 0.30 | 1.20 | 0.025 | 0.005 | 11.0 | 16.30 | 0.20 | 2.80 | 0.55 | 0.009 | — | × | — | 12.7 | |
| C13 | 0.045 | 0.30 | 1.20 | 0.025 | 0.005 | 5.00 | 16.30 | 0.20 | 2.80 | 0.55 | 0.009 | — | × | — | 11.9 | |
| C14 | 0.045 | 0.30 | 1.20 | 0.025 | 0.005 | 7.50 | 14.00 | 0.20 | 2.80 | 0.55 | 0.009 | — | × | — | 12.1 | |
| C15 | 0.045 | 0.30 | 1.20 | 0.025 | 0.005 | 7.50 | 16.30 | 0.20 | 5.00 | 0.55 | 0.009 | — | × | — | 12.0 | |
| C16 | 0.045 | 0.30 | 1.20 | 0.025 | 0.005 | 7.50 | 16.30 | 0.20 | 0.07 | 0.55 | 0.009 | — | × | — | 12.1 | |
| C17 | 0.045 | 0.30 | 1.20 | 0.025 | 0.005 | 7.50 | 16.30 | 0.20 | 2.80 | 3.00 | 0.009 | — | × | — | 12.2 | |

Note 1) LDR
○: LDR of not less than 2.20,
×: LDR of less than 2.20
Note 2) Season cracking
○: No season cracking at drawing ratio of 2.20,
×: Occurence of season cracking,
—: Working impossible at drawing ration of 2.20

As seen from Tables 1 and 2, all of the invention steels (A1–A19 steels) exhibit LDR≧2.20 and no occurrence of season cracking. Furthermore, the invention steels exhibit an Erichsen value equal to or more than that of the comparative steels and are excellent in the bulging property.

In the comparative steels (C1–C17 steels), the season cracking is created in C1 steel having a low Mo content and C2 steel having a high Si content, while LDR is low in C3 steel having a high N content and C4 steel (SUS304) containing no Al and Cu, and the susceptibility to season cracking is high in C5 steel containing Cu but no Al. Moreover, the season cracking is caused in C6 steel being outside range of C %, while C7–C17 steels being outside ranges of Ni, Mo, Cr, Cu and Al are poor in the deep drawability because LDR is less than 2.20.

Example 2

Molten steels having a chemical composition as shown in Table 3 are continuously cast into slabs, which are heated to 1250° C. and hot rolled to hot rolled sheets of 4 mm thickness×1050 mm width over a proper length, during which the occurrence of edge cracking is measured. The result are also shown in Table 3. As seen from Table 3, in the B2 and B3 steels containing B, the edge cracking is not caused, so that the production yield is improved and is advantageous economically.

TABLE 3

| Steel | (wt %) | | | | | | | | | | | | Edge cracking | |
|---|---|---|---|---|---|---|---|---|---|---|---|---|---|---|
| No. | C | Si | Mn | P | S | Ni | Cr | Mo | Cu | Al | N | B | in hot rolling | Remarks |
| B1 | 0.045 | 0.30 | 1.10 | 0.025 | 0.005 | 8.21 | 16.55 | 0.22 | 2.68 | 0.65 | 0.008 | 0.0005 | Occurrence | Second |
| B2 | 0.040 | 0.31 | 1.18 | 0.024 | 0.005 | 7.85 | 16.25 | 0.18 | 2.71 | 0.60 | 0.011 | 0.0038 | No Occurrence | invention |
| B3 | 0.049 | 0.33 | 1.19 | 0.025 | 0.004 | 7.59 | 16.32 | 0.20 | 2.58 | 0.55 | 0.012 | 0.0058 | No Occurrence | steel |

Example 3

Austenitic stainless steels having a chemical composition as shown in Table 4 (invention steels) and Table 5 (comparative steels) are prepared and subjected to usual hot rolling and cold rolling to a final thickness of 1.0 mm, which are then subjected to an annealing at 1100° C. for 30 seconds. The thus annealed sheet is subjected to a cylindrical deep drawing test through a flat bottom punch of 40 mm in diameter. The deep drawability is evaluated at a stage that a limit drawing ratio (LDR) is not less than 2.20 or less than 2.20, while the bulging property is evaluated by a limit forming height at a drawing ratio of 2.50 (cup height at a time of breaking the deep drawn cup). Further, the resistance to season cracking is evaluated by the presence or absence of cracking after the drawn cup prepared at the drawing ratio of 2.20 is left to stand at room temperature for 100 hours.

TABLE 4

| | (wt %) | | | | | | | | | | | | | | | | |
|---|---|---|---|---|---|---|---|---|---|---|---|---|---|---|---|---|---|
| No. | C | Si | Mn | P | S | Ni | Cr | Mo | Cu | Al | N | B | Ni equivalent | C + N | LDR* | Forming height** | Remarks |
| 1 | 0.042 | 0.55 | 1.05 | 0.014 | 0.005 | 7.50 | 16.5 | — | 2.00 | 0.70 | 0.018 | — | 21.20 | 0.060 | ○ | B | Third |
| 2 | 0.042 | 0.55 | 1.05 | 0.014 | 0.005 | 8.40 | 16.5 | — | 2.00 | 0.70 | 0.018 | — | 22.10 | 0.060 | ○ | A | invention |
| 3 | 0.042 | 0.55 | 1.05 | 0.014 | 0.005 | 9.00 | 16.5 | — | 2.00 | 0.70 | 0.018 | — | 22.70 | 0.060 | ○ | B | steel |
| 4 | 0.035 | 0.50 | 1.05 | 0.014 | 0.005 | 8.40 | 16.5 | — | 2.00 | 0.70 | 0.018 | — | 22.00 | 0.053 | ○ | B | |
| 5 | 0.045 | 0.55 | 1.05 | 0.014 | 0.005 | 8.30 | 16.5 | — | 2.00 | 0.70 | 0.018 | — | 22.03 | 0.063 | ○ | A | |
| 6 | 0.055 | 0.55 | 1.05 | 0.014 | 0.005 | 8.20 | 16.5 | — | 2.00 | 0.70 | 0.018 | — | 22.06 | 0.073 | ○ | A | |
| 7 | 0.065 | 0.55 | 1.05 | 0.014 | 0.005 | 8.10 | 16.5 | — | 2.00 | 0.70 | 0.018 | — | 22.09 | 0.083 | ○ | A | |
| 8 | 0.075 | 0.55 | 1.05 | 0.014 | 0.005 | 7.90 | 16.5 | — | 2.00 | 0.70 | 0.018 | — | 22.01 | 0.093 | ○ | A | |
| 9 | 0.050 | 0.55 | 1.10 | 0.029 | 0.005 | 7.52 | 16.8 | — | 2.55 | 0.47 | 0.018 | — | 21.99 | 0.068 | ○ | B | |
| 10 | 0.053 | 0.57 | 1.05 | 0.028 | 0.005 | 7.55 | 16.7 | — | 2.50 | 0.52 | 0.040 | — | 22.17 | 0.098 | ○ | B | |
| 11 | 0.050 | 0.57 | 2.00 | 0.020 | 0.002 | 6.79 | 15.9 | — | 2.40 | 0.80 | 0.022 | — | 21.48 | 0.072 | ○ | B | |
| 12 | 0.070 | 0.75 | 1.05 | 0.020 | 0.005 | 7.55 | 16.5 | — | 2.50 | 0.70 | 0.018 | — | 21.97 | 0.088 | ⊘ | A | |
| 13 | 0.042 | 0.55 | 1.05 | 0.022 | 0.004 | 9.50 | 16.0 | — | 1.50 | 1.00 | 0.020 | — | 22.48 | 0.062 | ○ | A | |
| 14 | 0.032 | 0.55 | 1.05 | 0.015 | 0.005 | 7.64 | 15.8 | — | 3.15 | 0.80 | 0.012 | — | 21.32 | 0.044 | ○ | B | |
| 15 | 0.042 | 0.55 | 1.05 | 0.014 | 0.005 | 8.00 | 16.5 | 0.25 | 2.00 | 0.70 | 0.018 | — | 21.94 | 0.060 | ○ | A | Fourth invention steel |
| 16 | 0.042 | 0.55 | 1.05 | 0.014 | 0.005 | 8.00 | 16.5 | — | 2.00 | 0.70 | 0.018 | 0.003 | 21.70 | 0.060 | ○ | A | Fifth |
| 17 | 0.042 | 0.55 | 1.05 | 0.014 | 0.005 | 8.00 | 15.3 | 1.45 | 2.00 | 0.70 | 0.018 | 0.006 | 22.34 | 0.060 | ○ | A | invention steel |

*○: LDR of not less than 2.20, no season cracking after being left to stand for 100 hours,
×: LDR of less than 2.20
●: LDR of not less than 2.20, occurrence of season cracking after being left to stand for 100 hours,
**Forming height
A: not less than 30 mm,
B: not less than 26 mm but less than 30 mm,
C: less than 26 mm

TABLE 5

| | (wt %) | | | | | | | | | | | | | | | | |
|---|---|---|---|---|---|---|---|---|---|---|---|---|---|---|---|---|---|
| No. | C | Si | Mn | P | S | Ni | Cr | Mo | Cu | Al | N | B | Ni equivalent | C + N | LDR* | Forming height** | Remarks |
| 18 | 0.042 | 0.55 | 1.05 | 0.014 | 0.005 | 6.50 | 16.5 | — | 2.0 | 0.70 | 0.018 | — | 20.20 | 0.060 | × | C | Compar- |
| 19 | 0.042 | 0.55 | 1.05 | 0.014 | 0.005 | 9.50 | 16.5 | — | 2.0 | 0.70 | 0.018 | — | 23.20 | 0.060 | × | C | ative |
| 20 | 0.025 | 0.55 | 1.05 | 0.014 | 0.005 | 8.50 | 16.5 | — | 2.0 | 0.70 | 0.008 | — | 21.85 | 0.043 | × | C | steel |
| 21 | 0.120 | 0.55 | 1.05 | 0.014 | 0.005 | 7.40 | 16.5 | — | 2.0 | 0.70 | 0.018 | — | 22.08 | 0.138 | ● | — | |
| 22 | 0.016 | 1.53 | 1.89 | 0.010 | 0.010 | 8.23 | 16.7 | — | 1.3 | 0.43 | 0.032 | — | 22.85 | 0.048 | × | C | |
| 23 | 0.042 | 0.40 | 1.05 | 0.028 | 0.002 | 7.50 | 16.5 | — | 2.0 | 0.70 | 0.018 | — | 21.14 | 0.060 | × | C | |

TABLE 5-continued

| No. | C | Si | Mn | P | S | Ni | Cr | Mo | Cu | Al | N | B | Ni equivalent | C + N | LDR* | Forming height** | Remarks |
|---|---|---|---|---|---|---|---|---|---|---|---|---|---|---|---|---|---|
| | (wt %) | | | | | | | | | | | | | | | | |
| 24 | 0.042 | 1.20 | 1.05 | 0.020 | 0.005 | 7.50 | 16.5 | — | 2.0 | 0.70 | 0.018 | — | 21.42 | 0.060 | ● | — | |
| 25 | 0.042 | 0.55 | 1.05 | 0.021 | 0.003 | 7.50 | 16.5 | — | 2.0 | 0.40 | 0.018 | — | 21.32 | 0.060 | × | C | |
| 26 | 0.042 | 0.55 | 1.05 | 0.018 | 0.004 | 8.20 | 16.5 | — | 2.0 | 2.30 | 0.018 | — | 21.26 | 0.060 | × | C | |
| 27 | 0.042 | 0.55 | 1.90 | 0.014 | 0.005 | 9.70 | 16.5 | — | 2.0 | 0.70 | 0.018 | — | 24.29 | 0.060 | × | C | |

*○: LDR of not less than 2.20, no season cracking after being left to stand for 100 hours,
×: LDR of less than 2.20
●: LDR of not less than 2.20, occurrence of season cracking after being left to stand for 100 hours,
**Forming height
A: not less than 30 mm,
B: not less than 26 mm but less than 30 mm,
C: less than 26 mm As seen from Table 4, all of the invention steels (Nos. 1–18) exhibit LDR≧2.20 and are excellent in the deep drawability and resistance to season cracking because the cracking is not created after being left to stand for 100 hours. Furthermore, the forming height is not less than 26 mm and the bulging property is good.

Among the comparative steels (Nos. 18–27), the steel (No. 21) being outside C+N range and the steels (Nos. 18 and 22) being outside Ni equivalent have LDR of less than 2.20 and are bad in the deep drawability, and the steels (Nos. 21, 24) being outside C, Si ranges create the season cracking after being left to stand for 100 hours, and the steel (No. 26) having a higher Al content has LDR of less than 2.20 and shows a bad result.

FIG. 1 is a graph showing a relation between limit drawing ratio (LDR) and C content in Cu and Al containing steels (Nos. 4, 5, 6, 7, 8, 20, 21) when the Ni equivalent is 22%. When the C content is not less than 0.03 wt %, LDR is 2.30 and the deep drawability is very excellent. On the other hand, when C=0.12 wt %, the season cracking is created.

From this figure, it is understood that in order to obtain super-deep drawing (LDR≧2.20), the C content is necessary to be not less than 0.03 wt %, desirably C≧0.04 wt %.

Figure 2:
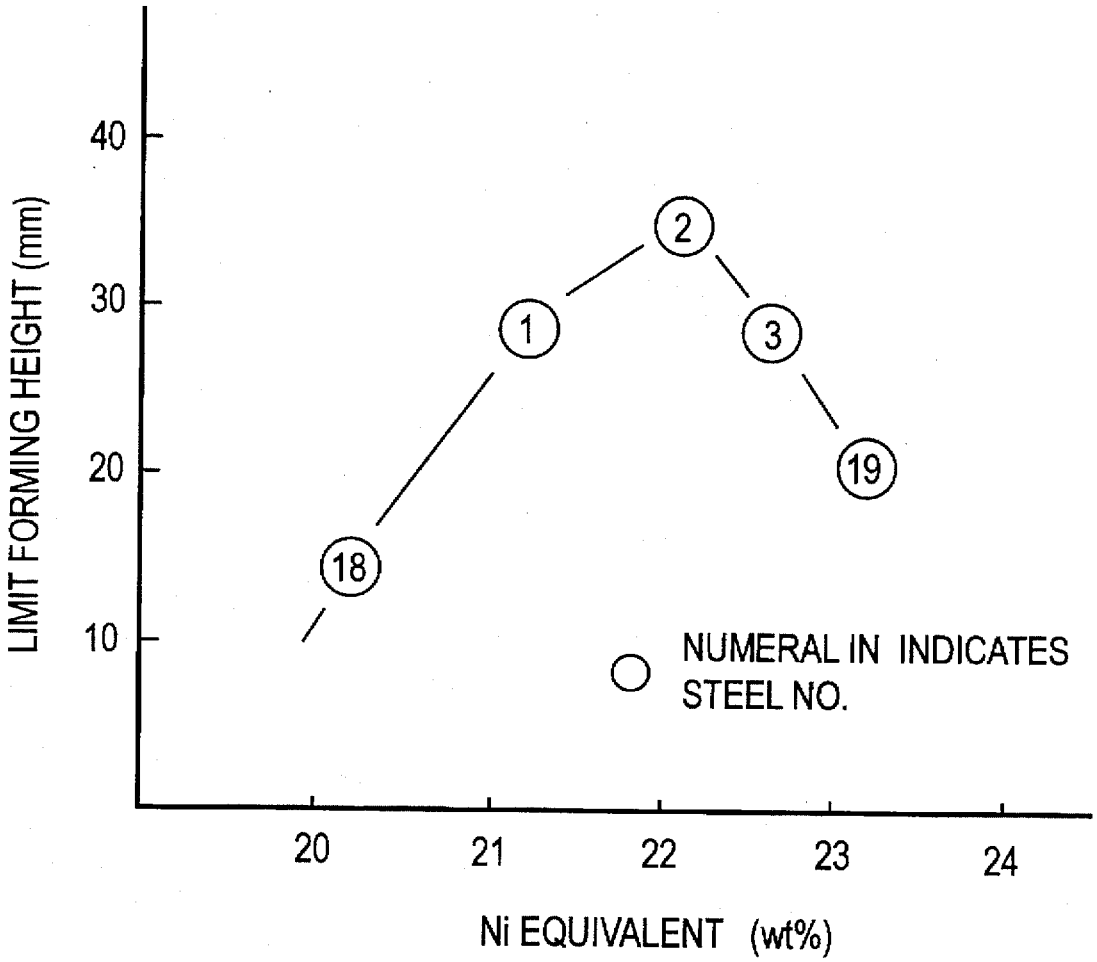
FIG. 2 is a graph showing a relation between Ni equivalent and limit forming height in Example 3.

Further, FIG. 2 is a graph showing a relation between Ni equivalent and limit forming height in Cu, Al containing steels (Nos. 1, 2, 3, 18, 19) having C=0.04 wt %. When the Ni equivalent is within a range of 21.0 but less than 22.8 wt %, the limit forming height of not less than 26 mm is obtained. In order to obtain a good bulging property, therefore, it is found that the Ni equivalent is necessary to be controlled to the above range.

Example 4

Molten steels in Steel Nos. 2, 16 and 17 of Table 4 are continuously cast into slabs, which are then heated to 1250° C. and hot rolled to hot rolled steel sheets of 4 mm thickness and 1050 mm width, during which the occurrence of edge cracking is measured. The results are shown in Table 6.

As seen from Table 6, steel No. 16 containing B and steel No. 17 containing Mo and B create no edge cracking and hence the production yield is economically improved.

TABLE 6

| steel No. | Feature | Edge cracking in hot rolling |
|---|---|---|
| 2 | — | Occurrence |
| 16 | B containing | No occurrence |
| 17 | Mo + B containing | No occurrence |

Example 5

After the continuous casting of Steel No. 2, Steel No. 15 (containing Mo) and Steel No. 17 (containing Mo+B) shown in Table 4, the resulting slabs are subjected to hot rolling, cold rolling and if necessary, annealing according to usual manner, whereby product sheets having a thickness of 0.6 mm are obtained.

Figure 3:
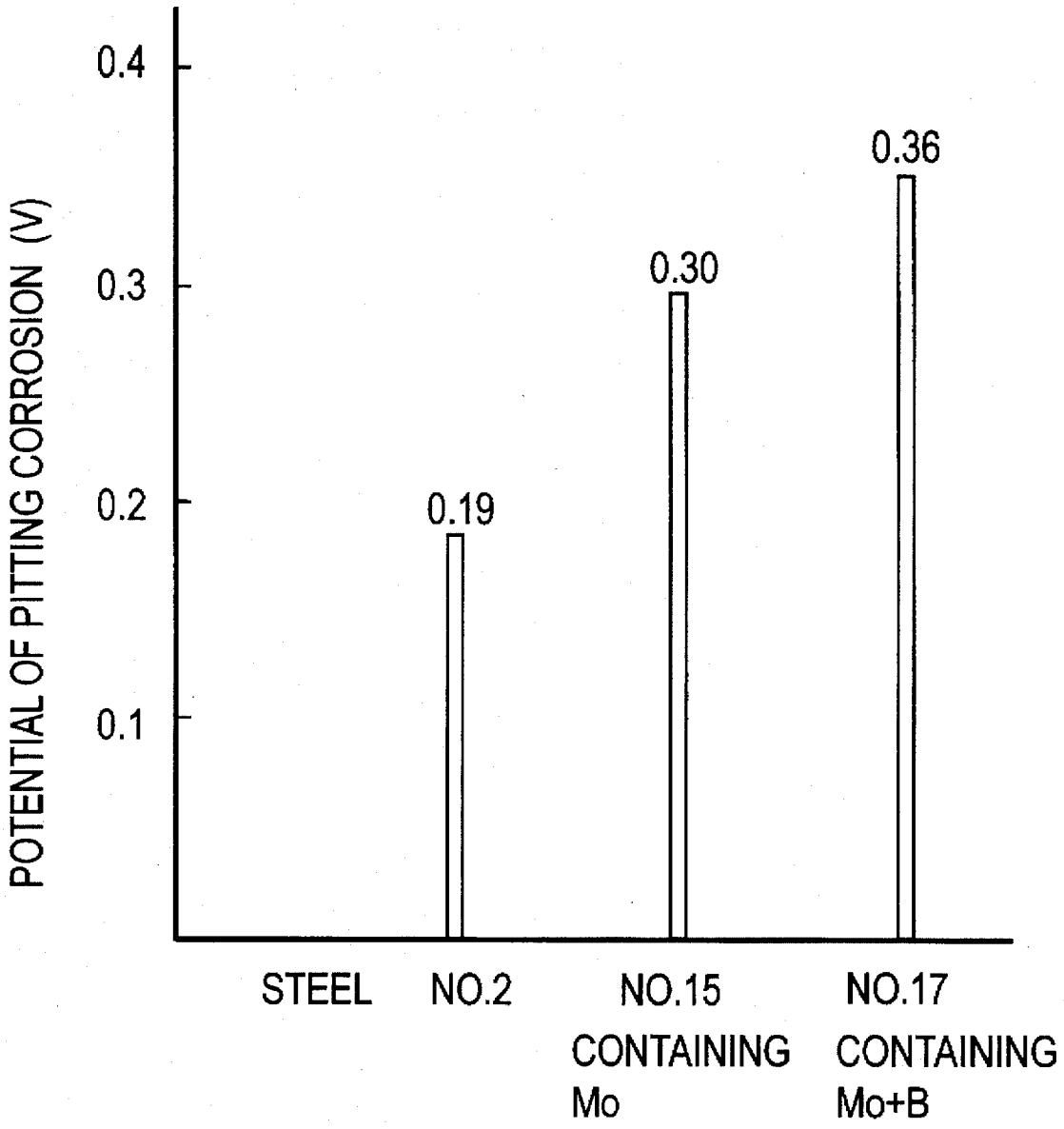
FIG. 3 is a graph showing results measured on a potential of pitting corrosion of Mo and B-containing stainless steel in Example 5.

The thus obtained product sheet is subjected to a test for corrosion resistance. This test is carried out according to JIS G0577 (method of measuring potential of pitting corrosion in stainless steel). The result is shown in FIG. 3. The stainless steels containing Mo, B (Nos. 15, 17) exhibit a high resistance to pitting corrosion.

Example 6

Austenitic stainless steels having a chemical composition as shown in Table 7 are subjected to usual hot rolling and cold rolling to a final thickness of 1.0 mm, which are then subjected to an annealing at 1100° C. for 30 seconds. The thus annealed sheet is subjected to a cylindrical deep drawing test through a flat bottom punch of 40 mm in diameter. The deep drawability is evaluated at a stage that a limit drawing ratio (LDR) is not less than 2.20 or less than 2.20, while the bulging property is evaluated by a limit forming height at a drawing ratio of 2.50 (cup height at a time of breaking the deep drawn cup). Further, the resistance to season cracking is evaluated by the presence or absence of cracking after the drawn cup prepared at the drawing ratio of 2.20 is left to stand at room temperature for 100 hours.

TABLE 7

| No. | C | Si | Mn | P | S | Ni | Cr | Mo | Cu | Al | N | B | Ni equivalent | LDR* | Forming height** | Remarks |
|---|---|---|---|---|---|---|---|---|---|---|---|---|---|---|---|---|
| | (wt %) | | | | | | | | | | | | | | | |
| 31 | 0.035 | 0.30 | 1.10 | 0.029 | 0.005 | 7.70 | 16.8 | — | 2.55 | 0.70 | 0.018 | — | 21.80 | ○ | B | Sixth |
| 32 | 0.046 | 0.23 | 1.22 | 0.028 | 0.005 | 7.55 | 16.7 | — | 2.03 | 0.52 | 0.040 | — | 21.86 | ○ | B | invention steel |
| 33 | 0.051 | 0.30 | 1.03 | 0.020 | 0.002 | 8.30 | 15.5 | — | 2.00 | 0.70 | 0.018 | — | 22.00 | ○ | A | |
| 34 | 0.060 | 0.30 | 1.03 | 0.020 | 0.002 | 8.20 | 16.5 | — | 2.00 | 0.70 | 0.018 | — | 22.01 | ○ | A | |
| 35 | 0.070 | 0.30 | 1.03 | 0.020 | 0.002 | 8.10 | 16.5 | — | 2.00 | 0.70 | 0.018 | — | 22.04 | ○ | A | |
| 36 | 0.080 | 0.30 | 1.03 | 0.020 | 0.002 | 7.94 | 16.5 | — | 2.00 | 0.70 | 0.018 | — | 22.01 | ○ | A | |
| 37 | 0.090 | 0.30 | 1.03 | 0.020 | 0.002 | 7.79 | 16.5 | — | 2.00 | 0.70 | 0.018 | — | 21.98 | ○ | A | |
| 38 | 0.051 | 0.30 | 1.03 | 0.020 | 0.002 | 7.40 | 16.5 | — | 2.00 | 0.70 | 0.018 | — | 21.10 | ○ | B | |
| 39 | 0.051 | 0.30 | 1.03 | 0.020 | 0.002 | 8.80 | 16.5 | — | 2.00 | 0.70 | 0.018 | — | 22.50 | ○ | A | |
| 40 | 0.055 | 0.41 | 1.05 | 0.014 | 0.005 | 7.79 | 16.7 | 0.26 | 2.00 | 1.50 | 0.020 | — | 21.69 | ○ | B | Seventh invention steel |
| 41 | 0.052 | 0.22 | 1.05 | 0.020 | 0.005 | 7.75 | 16.5 | — | 2.50 | 0.70 | 0.018 | 0.005 | 21.76 | ○ | A | Eighth |
| 42 | 0.053 | 0.33 | 1.05 | 0.022 | 0.004 | 8.26 | 15.2 | 1.50 | 1.50 | 0.60 | 0.020 | 0.004 | 22.41 | ○ | A | invention steel |
| 43 | 0.026 | 0.35 | 1.05 | 0.014 | 0.005 | 8.60 | 16.5 | — | 2.00 | 0.70 | 0.018 | — | 22.02 | × | C | Comparative |
| 44 | 0.130 | 0.41 | 1.05 | 0.029 | 0.005 | 7.30 | 16.5 | — | 2.00 | 0.70 | 0.018 | — | 22.06 | ● | — | steel |
| 45 | 0.052 | 0.33 | 1.05 | 0.028 | 0.002 | 6.20 | 16.5 | — | 2.00 | 0.70 | 0.018 | — | 19.95 | × | C | |
| 46 | 0.053 | 0.33 | 1.05 | 0.020 | 0.005 | 9.40 | 16.5 | — | 2.00 | 0.70 | 0.018 | — | 23.16 | × | C | |

*○: LDR of not less than 2.20, no season cracking after being left to stand for 100 hours,
×: LDR of less than 2.20
●: LDR of not less than 2.20, occurrence of season cracking after being left to stand for 100 hours,
**Forming height
A: not less than 30 mm,
B: not less than 26 mm but less than 30 mm,
C: less than 26 mm As seen from Table 7, all of the invention steels (Nos. 31–42) exhibit LDR≧2.20 and are excellent in the deep drawability and the resistance to season cracking because the cracking is not created after being left to stand for 100 hours. Furthermore, the forming height is not less than 26 mm and the bulging property is good.

Among the comparative steels (Nos. 43–46), the steel No. 43 having C content of less than 0.03 wt % and the steels Nos. 45, 46 being outside Ni equivalent have LDR of less than 2.20 and are low in the limit forming height. Further, the steel No. 44 exceeding upper limit of C content creates the season cracking.

Figure 4:
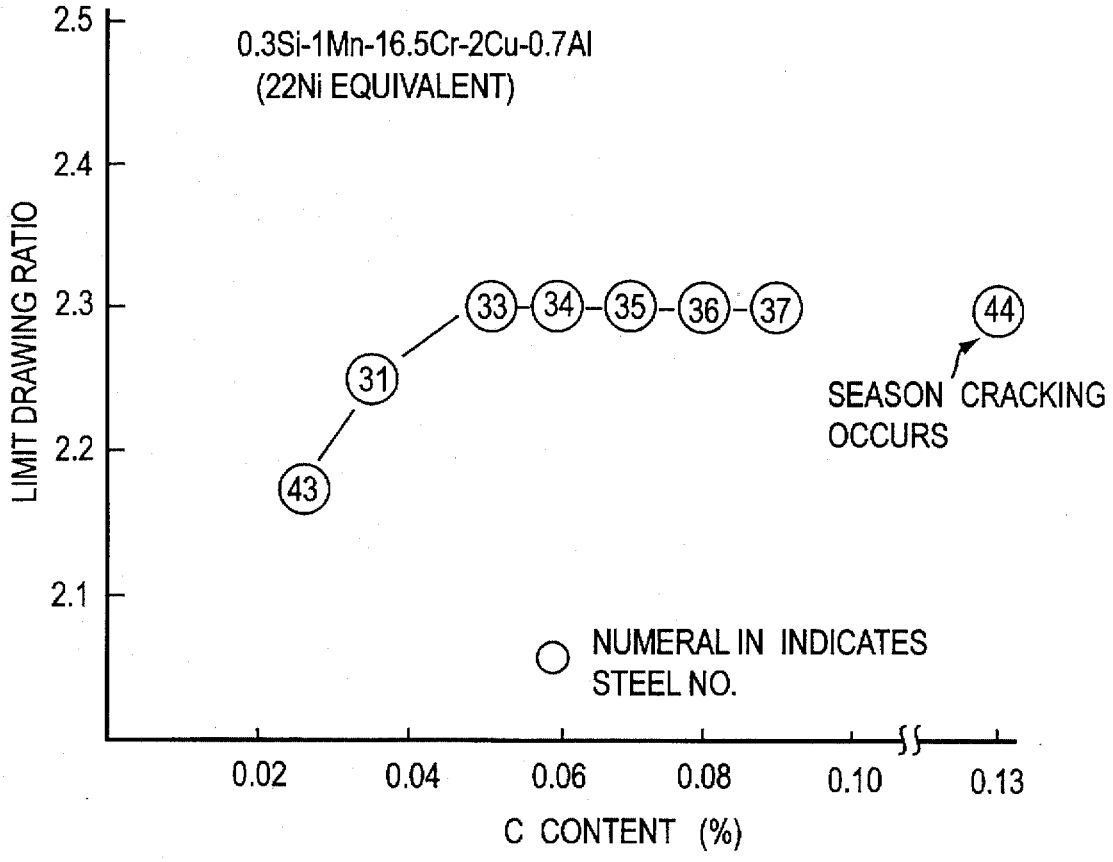
FIG. 4 is a graph showing a relation between C content and limit drawing ratio in Example 6.

FIG. 4 is a graph showing a relation between limit drawing ratio (LDR) and C content in Cu and Al containing steels when the Ni equivalent is 22%. When the C content exceeds 0.03 wt %, LDR is as very high as LDR=2.30. However, the season cracking is created at C=0.03 wt %.

From this figure, it is understood that in order to obtain steels having LDR≧2.20, the C content is necessary to be not less than 0.03 wt %, and further the C content is within a range of more than 0.05 but 0.10 wt % in order to obtain a higher LDR.

Figure 5:
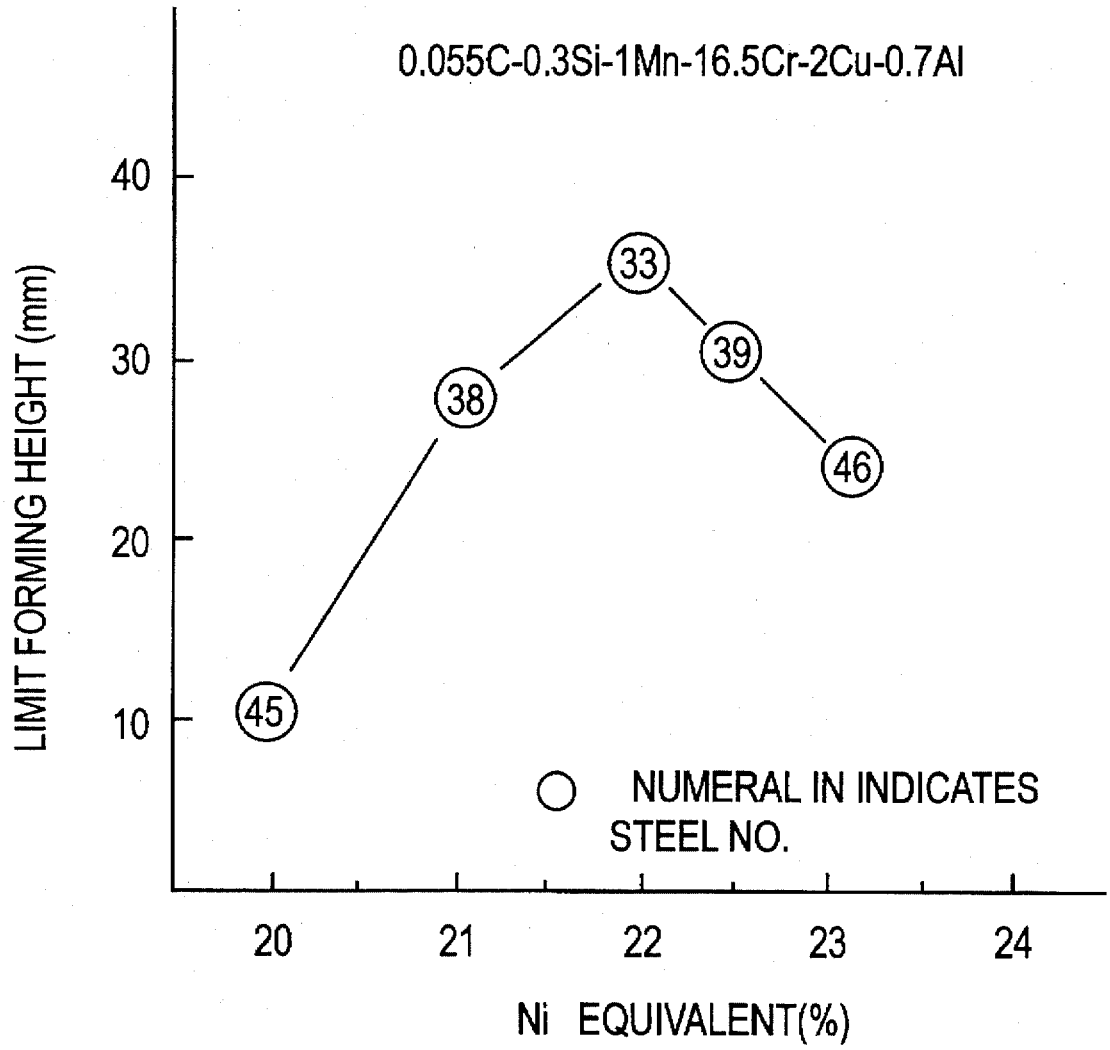
FIG. 5 is a graph showing a relation between Ni equivalent and limit forming height in Example 6.

Further, FIG. 5 is a graph showing a relation between Ni equivalent and limit forming height in the Cu, Al containing steel having C=0.05 wt %. When the Ni equivalent is within a range of 21.0–23.0 wt %, the limit forming height of not less than 26 mm is obtained. In order to obtain the good bulging property, therefore, it is necessary to control the Ni equivalent.

Example 7

Molten steels in Steel Nos. 33, 41 and 42 of Table 7 are continuously cast into slabs, which are then heated to 1250° C. and hot rolled to hot rolled steel sheets of 4 mm thickness and 1050 mm width, during which the occurrence of edge cracking is measured. The results are shown in Table 8.

As seen from Table 8, steel No. 41 containing B and steel No. 42 containing Mo and B create no edge cracking and hence the production yield is economically improved.

TABLE 8

| steel No. | Feature | Edge cracking in hot rolling |
|---|---|---|
| 33 | — | Occurrence |
| 41 | B containing | No occurrence |
| 42 | Mo + B containing | No occurrence |

Example 8

After the continuous casting of Steel No. 33, Steel No. 40 (containing Mo) and Steel No. 42 (containing Mo+B) shown in Table 7, the resulting slab are subjected to hot rolling, cold rolling and if necessary, annealing according to usual manner, whereby product sheets having a thickness of 0.6 mm are obtained.

Figure 6:
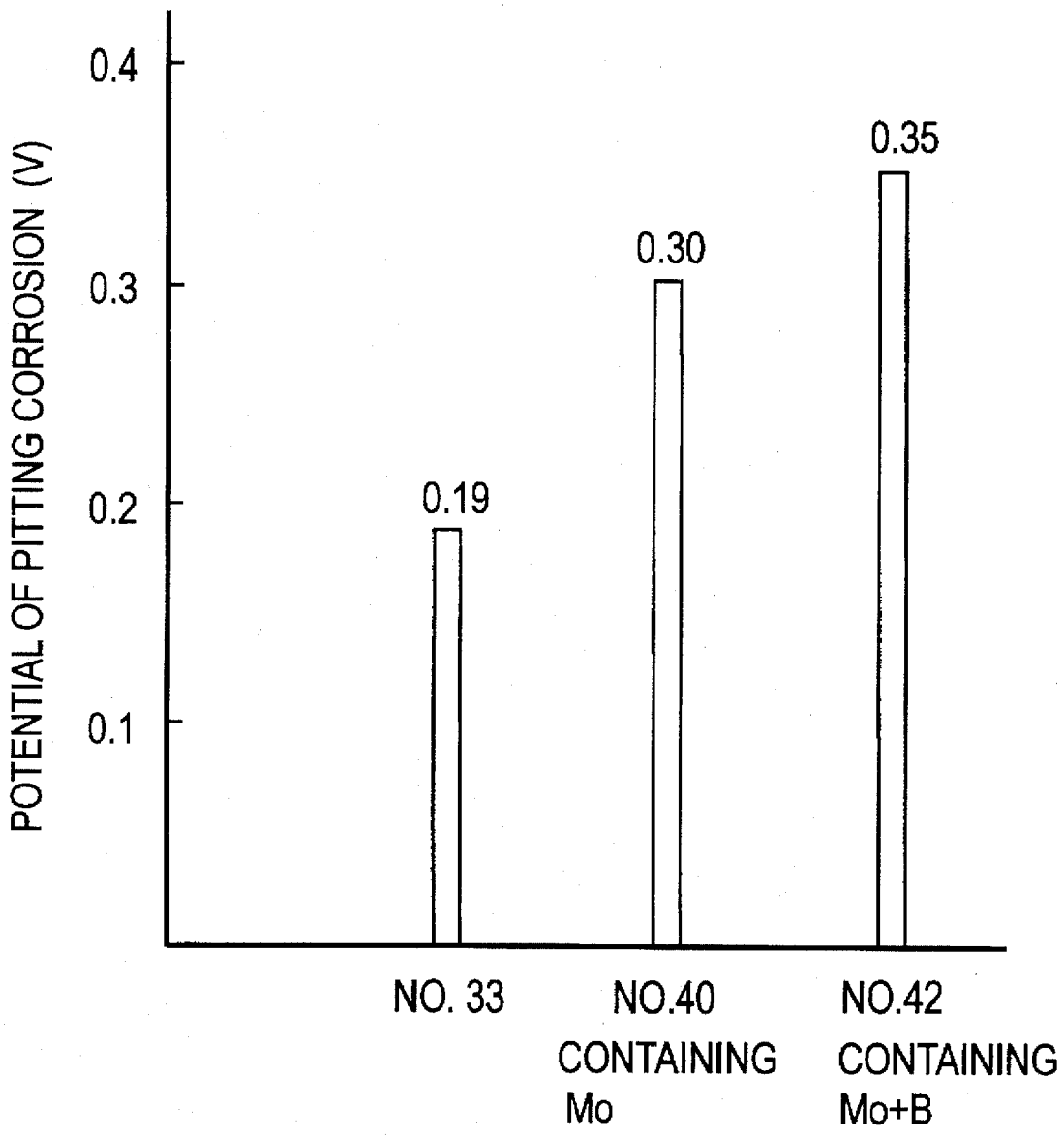
FIG. 6 is a graph showing results measured on potential of a pitting corrosion of Mo and B-containing stainless steel in Example 7.

The thus obtained product sheet is subjected to a test for corrosion resistance. This test is carried out according to JIS G0577 (method of measuring potential of pitting corrosion in stainless steel). The result is shown in FIG. 6. The stainless steels Nos. 40, 42 containing Mo, B exhibit a high resistance to pitting corrosion.

Example 9

Austenitic stainless steels having a chemical composition as shown in Table 9 are subjected to usual hot rolling and cold rolling to a final thickness of 1.0 mm, which are then subjected to an annealing at 1100° C. for 30 seconds. The thus annealed sheet is subjected to a cylindrical deep drawing test through a flat bottom punch of 40 mm in diameter. The deep drawability is evaluated at a stage that a limit drawing ratio (LDR) is not less than 2.20 or less than 2.20, while the bulging property is evaluated by a limit forming height at a drawing ratio of 2.50. Further, the resistance to season cracking is evaluated by the presence or absence of cracking after the drawn cup prepared at the drawing ratio of 2.20 is left to stand at room temperature for 100 hours.

TABLE 9

| | (wt %) | | | | | | | | | | | | | | Limit | |
|---|---|---|---|---|---|---|---|---|---|---|---|---|---|---|---|---|
| No. | C | Si | Mn | P | S | Ni | Cr | Mo | Cu | Al | N | B | Ni equivalent | LDR* | forming height** | Remarks |
| 51 | 0.035 | 0.30 | 1.10 | 0.029 | 0.005 | 7.80 | 16.80 | — | 2.55 | 0.46 | 0.018 | — | 21.99 | ○ | B | Ninth |
| 52 | 0.055 | 0.30 | 1.10 | 0.029 | 0.005 | 7.60 | 16.80 | — | 2.55 | 0.46 | 0.018 | — | 22.05 | ○ | A | invention steel |
| 53 | 0.095 | 0.30 | 1.10 | 0.029 | 0.005 | 7.10 | 16.80 | — | 2.55 | 0.46 | 0.018 | — | 22.50 | ○ | A | |
| 54 | 0.042 | 0.42 | 1.10 | 0.029 | 0.005 | 7.52 | 16.80 | 0.26 | 2.55 | 0.46 | 0.018 | — | 22.10 | ○ | B | Tenth invention steel |
| 55 | 0.060 | 0.21 | 1.05 | 0.028 | 0.005 | 7.55 | 16.70 | — | 2.50 | 0.31 | 0.040 | 0.005 | 22.22 | ○ | A | Eleventh |
| 56 | 0.055 | 0.31 | 1.05 | 0.026 | 0.003 | 6.91 | 15.50 | 1.55 | 2.40 | 0.25 | 0.010 | 0.005 | 22.00 | ○ | A | invention steel |
| 57 | 0.055 | 0.30 | 1.10 | 0.029 | 0.005 | 8.30 | 16.80 | — | 2.55 | 0.46 | 0.018 | — | 21.55 | ○ | A | Ninth |
| 58 | 0.055 | 0.30 | 1.10 | 0.029 | 0.005 | 8.30 | 16.80 | — | 2.55 | 0.46 | 0.018 | — | 22.75 | ○ | A | invention steel |
| 59 | 0.020 | 0.30 | 1.10 | 0.029 | 0.005 | 8.00 | 16.80 | — | 2.55 | 0.46 | 0.108 | — | 22.00 | × | C | Comparative |
| 60 | 0.120 | 0.30 | 1.10 | 0.029 | 0.005 | 6.80 | 16.80 | — | 2.55 | 0.46 | 0.018 | — | 22.06 | ● | — | steel |
| 61 | 0.075 | 0.42 | 2.00 | 0.020 | 0.002 | 6.79 | 15.94 | — | 2.40 | 0.15 | 0.022 | — | 22.00 | × | C | |
| 62 | 0.042 | 0.32 | 1.10 | 0.029 | 0.005 | 7.52 | 16.80 | — | 2.55 | 0.60 | 0.018 | — | 21.75 | ○fault in hot rolled sheet | — | |
| 63 | 0.055 | 0.30 | 1.10 | 0.029 | 0.005 | 6.10 | 16.80 | — | 2.55 | 0.46 | 0.018 | — | 20.55 | × | C | |
| 64 | 0.055 | 0.30 | 1.10 | 0.029 | 0.005 | 8.70 | 16.80 | — | 2.55 | 0.46 | 0.018 | — | 23.15 | × | C | |
| 65 | 0.044 | 0.25 | 1.22 | 0.004 | 0.005 | 7.78 | 16.75 | — | 2.03 | 0.63 | 0.022 | — | 21.83 | ○fault in hot rolled sheet | — | |

*○:LDR of not less than 2.20, no season cracking after being left to stand for 100 hours,
×: LDR of less than 2.20
●: LDR of not less than 2.20, occurrence of season cracking after being left to stand for 100 hours,
**Forming height
A: not less than 30 mm,
B: not less than 26 mm but less than 30 mm,
C: less than 26 mm As seen from Table 9, all of the invention steels (Nos. 51–58) exhibit LDR≧2.20 and are excellent in the deep drawability and the resistance to season cracking because the cracking is not created after being left to stand for 100 hours. Furthermore, the forming height is not less than 26 mm and the bulging property is good.

Among the comparative steels (Nos. 59–65), the steel (No. 59) having C content of less than 0.03 wt %, the steel (No. 61) being outside Al content and the steels Nos. 63, 64 being outside Ni equivalent have LDR of less than 2.20 and are poor in the deep drawability. Further, the steel (No. 60) exceeding C content of 0.10 wt % creates the season cracking. In the steels Nos. 62, 65 exceeding Al, fault is created on the sheet to considerably degrade the surface properties.

Figure 7:
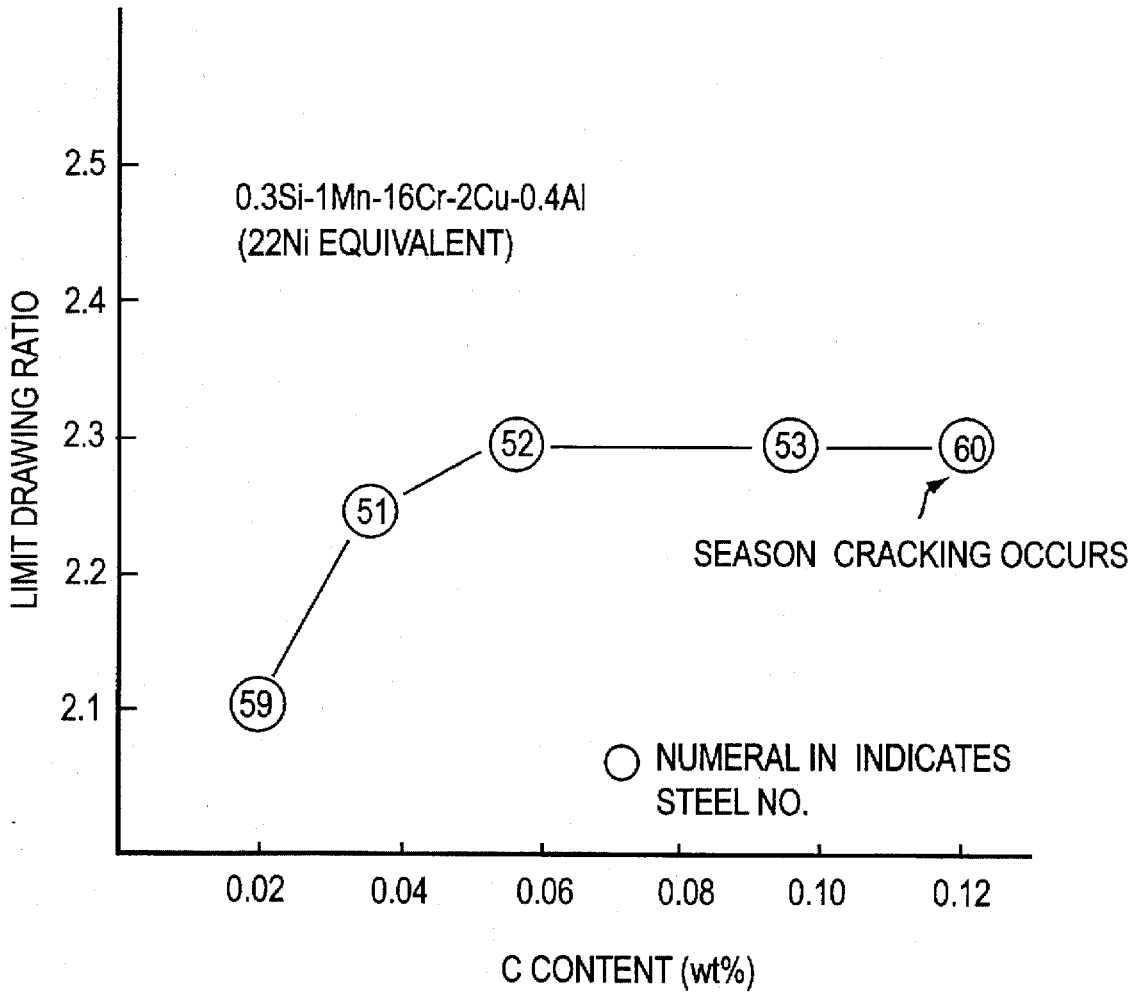
FIG. 7 is a graph showing a relation between C content and limit drawing ratio in Example 9.

FIG. 7 is a graph showing a relation between limit drawing ratio (LDR) and C content in Cu and Al containing steels (Nos. 51, 52, 53, 59, 60) when the Ni equivalent is 22%. When the C content is not less than 0.03 wt %, LDR is not less than 2.20, while when the C content is not less than 0.04 wt %, LDR is 2.30 and the deep drawability is very excellent. However, the season cracking is created at C=0.12 wt %.

From this figure, it is understood that in order to obtain super-deep drawability (LDR≧2.20), the C content is necessary to be not less than 0.03 wt %, desirability C≧0.04 wt %.

Figure 8:
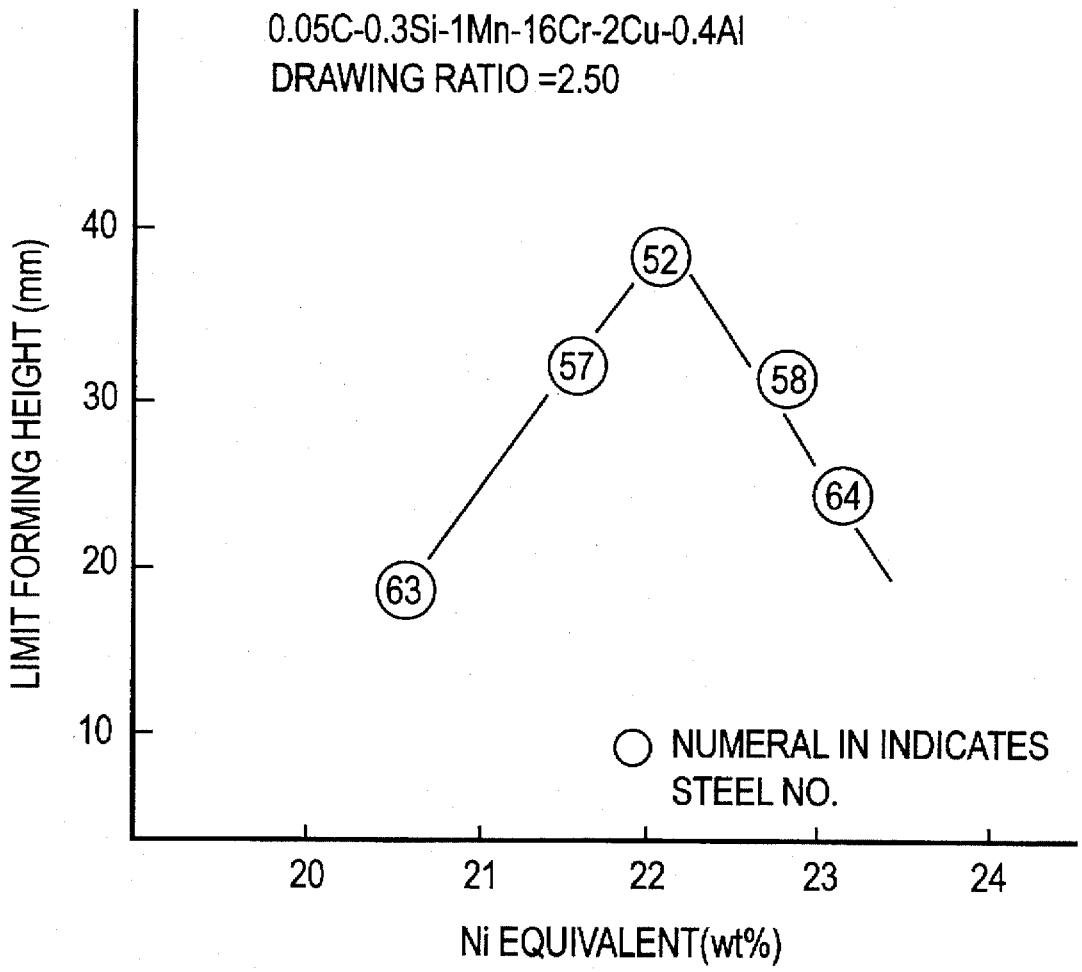
FIG. 8 is a graph showing a relation between Ni equivalent and limit forming height in Example 9.

Further, FIG. 8 is a graph showing a relation between Ni equivalent and limit forming height in the Cu, Al containing steels (Nos. 52, 57, 58, 63, 64) having C=0.05 wt %. When the Ni equivalent is within a range of 21.0–23.0 wt %, the limit forming height of not less than 26 mm is obtained. In order to obtain the good bulging property, therefore, it is necessary to control the Ni equivalent.

Example 10

Molten steels in Steel Nos. 52, 55 and 56 of Table 9 are continuously cast into slabs, which are then heated to 1250° C. and hot rolled to a hot rolled steel sheets of 4 mm thickness and 1050 mm width, during which the occurrence of edge cracking is measured. The results are shown in Table 10.

As seen from Table 10, steel No. 55 containing B and steel No. 56 containing Mo and B create no edge cracking and hence the production yield is economically improved.

TABLE 10

| Steel No. | Feature | Edge cracking in hot rolling |
|---|---|---|
| 52 | — | Occurrence |
| 55 | B containing | No Occurrence |
| 56 | Mo + B containing | No Occurrence |

Example 11

After the continuous casting of Steel No. 52, Steel No. 54 (containing Mo) and Steel No. 56 (containing Mo+B) shown in Table 9, the resulting slabs are subjected to hot rolling, cold rolling and if necessary, annealing according to usual manner, whereby product sheets having a thickness of 0.6 mm are obtained.

Figure 9:
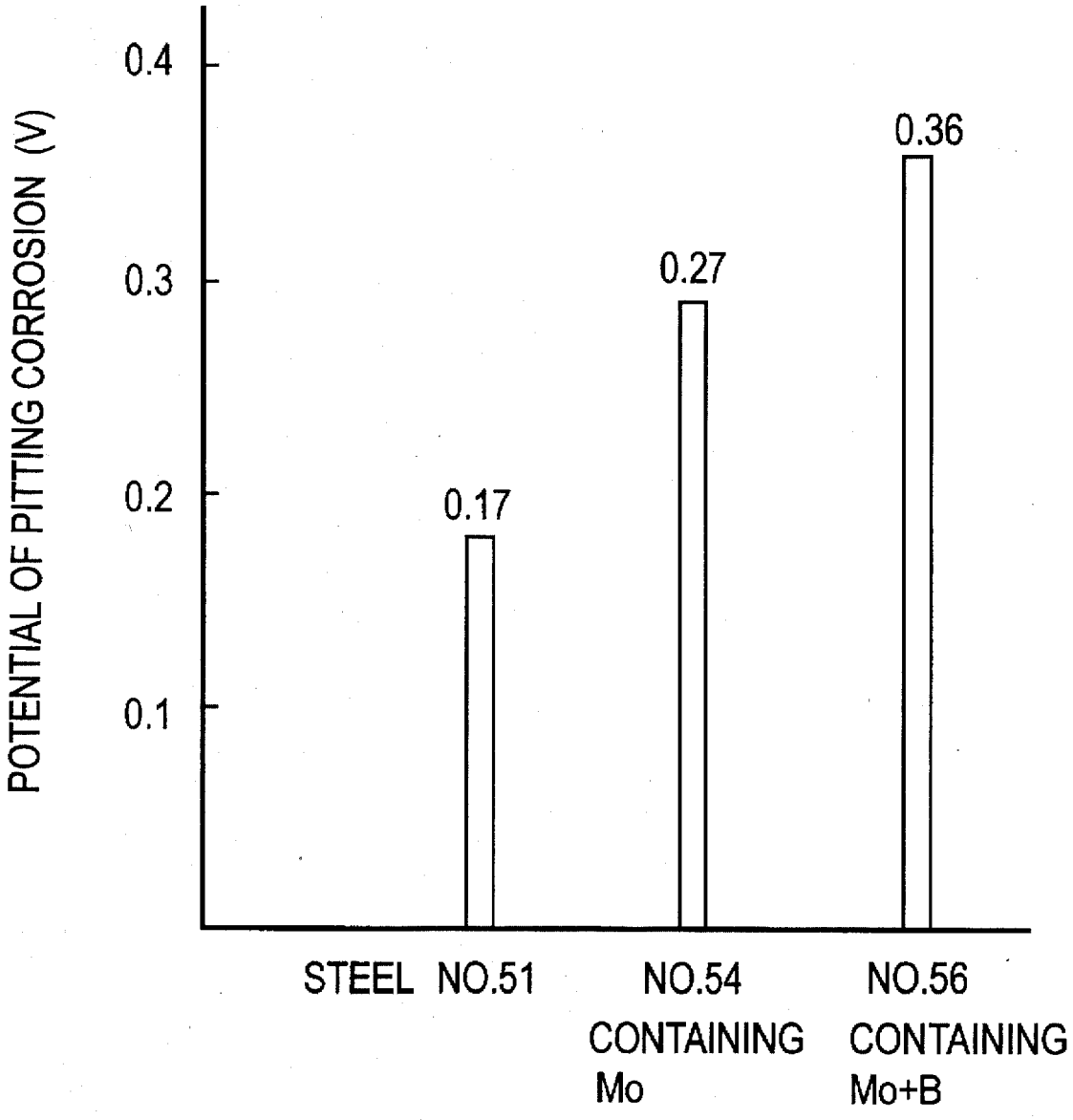
FIG. 9 is a graph showing results measured on potential of a pitting corrosion of Mo and B-containing stainless steel in Example 10.

The thus obtained product sheet is subjected to a test for corrosion resistance. This test is carried out according to JIS G0577 (method of measuring potential of pitting corrosion in stainless steel). The result is shown in FIG. 9. The stainless steels Nos. 54, 56 containing Mo. B exhibit a high resistance to pitting corrosion.

Example 12

Austenitic stainless steels having a chemical composition as shown in Table 11 are prepared and subjected to hot rolling and cold rolling according to a usual manner to produce thin sheets having a thickness of 1.0 mm, which are then annealed at 1000°–1150° C. for 10–60 seconds to adjust the crystal grain size number (N).

The thus annealed sheet is subjected to a cylindrical deep drawing test through a flat bottom punch of 40 mm in diameter. The deep drawability is evaluated at a stage that a limit drawing ratio (LDR) is not less than 2.20 or less than 2.20, while the bulging property is evaluated by a limit forming height at a drawing ratio (DR) of 2.50.

The grinding property is better as the surface roughness becomes small. In this example, the surface roughness (Rmax) of a bottom in a cylindrical deep drawn cup at a drawing ratio of 2.20 (a portion of strong bulging deformation) is measured, which is used as an indicator of the grinding property.

TABLE 11

| | Chemical composition (wt %) | | | | | | | | | | | | | |
|---|---|---|---|---|---|---|---|---|---|---|---|---|---|---|
| Steel No. | C | Si | Mn | P | S | Ni | Cr | Cu | Al | N | Mo | B | Ni equivalent | Remarks |
| 71 | 0.046 | 0.35 | 1.18 | 0.026 | 0.002 | 7.37 | 16.4 | 2.72 | 0.61 | 0.011 | — | | 21.5 | Twelfth invention steel |
| 72 | 0.056 | 0.39 | 1.10 | 0.027 | 0.002 | 7.22 | 16.6 | 2.70 | 0.45 | 0.012 | — | 0.0042 | 21.6 | Fourteenth invention steel |
| 73 | 0.047 | 0.34 | 1.20 | 0.025 | 0.002 | 6.90 | 16.5 | 2.68 | 0.58 | 0.010 | — | | 21.1 | Twelfth |
| 74 | 0.052 | 0.29 | 1.15 | 0.026 | 0.002 | 9.69 | 15.3 | 1.65 | 1.20 | 0.015 | — | | 22.3 | invention steel |
| 75 | 0.048 | 0.30 | 1.21 | 0.025 | 0.002 | 7.17 | 16.5 | 2.55 | 0.51 | 0.012 | 0.25 | 0.0035 | 21.6 | Fourteenth invention steel |
| 76 | 0.075 | 0.33 | 1.15 | 0.026 | 0.002 | 7.35 | 16.0 | 2.60 | 0.55 | 0.011 | 0.50 | | 22.0 | Thirteenth invention steel |
| 77 | 0.047 | 0.35 | 1.20 | 0.026 | 0.002 | 8.48 | 16.8 | 2.70 | 0.58 | 0.011 | — | | 22.9 | Comparative |
| 78 | 0.042 | 0.35 | 1.19 | 0.025 | 0.003 | 6.81 | 16.2 | 2.61 | 0.59 | 0.010 | — | | 20.7 | steel |
| 79 | 0.041 | 0.45 | 1.05 | 0.025 | 0.005 | 7.17 | 16.8 | 2.55 | — | 0.048 | — | | 22.0 | |
| 80 | 0.049 | 0.40 | 1.21 | 0.026 | 0.002 | 8.80 | 16.8 | — | 0.71 | 0.011 | — | | 21.6 | |
| 81 | 0.054 | 0.64 | 1.25 | 0.028 | 0.006 | 8.15 | 18.3 | — | — | 0.051 | — | | 22.9 | |
| 82 | 0.124 | 0.50 | 1.29 | 0.027 | 0.002 | 6.39 | 16.8 | 2.45 | 0.60 | 0.013 | — | | 21.8 | |

The measured results are shown in Table 12. In the steel Nos. 71–78 using the chemical composition adaptable to the invention (A–F), the crystal grain size number (N) is not less than 8.0, the deep drawability is good, the surface roughness (Rmax) is not more than 3.0μ, and the grinding property and press formability are excellent. On the contrary, the comparative steel No. 79 has a chemical composition corresponding to that of the invention, but is large in the crystal grain size and hence the grinding property is poor. Furthermore, the steels Nos. 80, 81 using steels G, H being outside Ni equivalent and the steels Nos. 82–84 being outside Cu, Al contents are poor in the deep drawability. Moreover, the steel No. 85 being outside the C content creates the season cracking at LDR≧2.20.

TABLE 12

| | No. | Kind of Steel | Rolling reduction (%) | Annealing temperature (°C.) | Annealing time (second) | crystal grain size | Deep drawability | R max (μ) |
|---|---|---|---|---|---|---|---|---|
| Invention steel | 71 | A | 60 | 1100 | 30 | 8.0 | ○ | 3.0 |
| | 72 | A | 60 | 1050 | 30 | 9.0 | ○ | 2.2 |
| | 73 | A | 60 | 1020 | 30 | 10.0 | ○ | 1.5 |
| | 74 | B | 60 | 1050 | 30 | 9.0 | ○ | 2.0 |
| | 75 | C | 60 | 1050 | 30 | 9.0 | ○ | 1.8 |
| | 76 | D | 60 | 1050 | 30 | 9.0 | ○ | 2.1 |
| | 77 | E | 60 | 1050 | 30 | 9.0 | ○ | 2.0 |
| | 78 | F | 60 | 1050 | 30 | 9.0 | ○ | 1.9 |
| Comparative steel | 79 | A | 60 | 1150 | 30 | 7.0 | ○ | 5.1 |
| | 80 | G | 60 | 1050 | 30 | 9.0 | × | — |
| | 81 | H | 60 | 1050 | 30 | 9.0 | × | — |
| | 82 | I | 60 | 1020 | 10 | 9.0 | × | — |
| | 83 | J | 60 | 1050 | 30 | 9.0 | × | — |

TABLE 12-continued

| No. | Kind of Steel | Rolling reduction (%) | Annealing temperature (°C.) | Annealing time (second) | crystal grain size | Deep drawability | R max (μ) |
|---|---|---|---|---|---|---|---|
| 84 | K | 60 | 1020 | 10 | 9.0 | × | — |
| 85 | L | 60 | 1050 | 30 | 9.0 | ● | — |

○: LDR ≧ 2.20,
×: < 2.20,
●: LDR ≧ 2.20 but season cracking occurs

Example 13

Slabs of an austenitic stainless steel having a chemical composition as shown in Table 13 are subjected to usual hot rolling and cold rolling to a final thickness of 1.0 mm, which are then annealed at 1100° C. for 30 seconds. In this case, the preparation of each alloy steel is carried out by melting in an electric furnace, reducing S content to 0.001 wt % in an AOD furnace, again conducting finish decarburization and then leaving to stand for a certain time to float inclusions.

The thus annealed sheet is adhered at its one-side surface with a protection vinyl resin film and subjected to a cylindrical deep drawing test through a flat bottom punch of 50 mm in diameter. In this case, the surface covered with the film is rendered into B punching side, whereby the bulging deformation of the deep drawn cup bottom can be uniformized and the bulging deformation quantity becomes large.

The deep drawability is evaluated at a stage that a limit drawing ratio (LDR) is not less than 2.20 or less than 2.20. The bulging property is evaluated by visually observing the bulged portion of the cup bottom at a drawing ratio of 2.20 to measure the presence or absence of cracking resulted from the inclusions (Test number: 100).

TABLE 13

| No. | Chemical Composition (wt %) | | | | | | | | | | | | |
|---|---|---|---|---|---|---|---|---|---|---|---|---|---|
| | C | Si | Mn | P | S | O | Ni | Cr | Mo | Cu | Al | N | B |
| 91 | 0.041 | 0.40 | 1.25 | 0.022 | 0.0010 | 0.0006 | 7.64 | 16.25 | — | 2.72 | 0.61 | 0.011 | — |
| 92 | 0.060 | 0.35 | 1.18 | 0.018 | 0.0008 | 0.0008 | 7.38 | 16.21 | 0.25 | 2.70 | 0.51 | 0.008 | — |
| 93 | 0.043 | 0.41 | 1.21 | 0.026 | 0.0012 | 0.0005 | 7.94 | 17.22 | — | 2.20 | 0.55 | 0.009 | 0.0052 |
| 94 | 0.054 | 0.42 | 1.20 | 0.025 | 0.0009 | 0.0013 | 7.89 | 17.41 | 0.31 | 1.71 | 0.62 | 0.010 | 0.0041 |
| 95 | 0.048 | 0.39 | 1.21 | 0.025 | 0.003 | 0.0024 | 7.66 | 16.30 | — | 2.70 | 0.59 | 0.012 | — |
| 96 | 0.051 | 0.60 | 1.08 | 0.026 | 0.006 | 0.0036 | 8.19 | 18.24 | — | — | — | 0.050 | — |

| No. | Ni equivalent (wt %) | Cleanness | LDR* | Occurrence of cracking** | Remarks |
|---|---|---|---|---|---|
| 91 | 21.7 | 0.013 | ○ | ○ | Fifteenth invention steel |
| 92 | 21.8 | 0.018 | ○ | ○ | Sixteenth invention steel |
| 93 | 22.3 | 0.013 | ○ | ○ | Seventeenth invention steel |
| 94 | 22.5 | 0.017 | ○ | ○ | |
| 95 | 21.8 | 0.029 | ○ | × | Comparative steel |
| 96 | 22.7 | 0.025 | × | — | |

*○: LDR ≧ 2.20, ×: LDR < 2.20
**○: no cracking, ×: occurrence of cracking in one of n = 100

As seen from Table 13, all of the invention steels (Nos. 91–94) exhibit LDR≧2.20 and have no cracking resulted from the inclusions in the bulged portion of the cup bottom and are excellent in the deep drawability and the bulging property.

On the contrary, the comparative steel No. 95 exhibits LDR of not less than 2.20 but exceeds the cleanness of 0.020, so that the cracking is observed in the cup bottom of drawing ratio=2.20 (7 in 100). Further, the comparative steel No. 96 is SUS 304 steel containing no Al and Cu and having LDR of less than 2.20 so that the evaluation of the cracking due to the inclusions can not be conducted.

What is claimed is:

1. An austenitic stainless steel for press forming comprising C: 0.01–0.10 wt %, Si: not more than 1.0 wt %, Mn: not more than 3.0 wt %, Ni: 6.0–10.0 wt %, Cr: 15.0–19.0 wt %, Mo: 0.03–3.0 wt %, Cu: 1.0–4.0 wt %, Al: 0.2–2.5 wt %, N: not more than 0.05 wt % and the balance being iron and inevitable impurities.

2. An austenitic stainless steel according to claim 1, wherein said steel further includes B: 0.0010–0.020 wt %.

3. An austenitic stainless steel for press forming comprising C: 0.03–0.10 wt %, Si: less than 0.5 wt %, Mn: not more than 3.0 wt %, Ni: 6.0–10.0 wt %, Cr: 15.0–19.0 wt %, Cu: 1.0–4.0 wt %, Al: 0.2–less than 0.5 wt %, N: not more than 0.05 wt % and the balance being iron and inevitable impurities, in which Ni equivalent (wt %) represented by the following equation is within a range of 21.0–23.0

$$\text{Ni equivalent (wt \%)}=12.6(C+N)+0.35Si+1.05Mn+Ni+0.65Cr+0.6Cu-0.4Al.$$

4. An austenitic stainless steel according to claim 3, wherein said steel further contains B: 0.0010–0.020 wt %.

5. An austenitic stainless steel for press forming comprising C: 0.01–0.10 wt %, Si: not more than 1.0 wt %, Mn: not more than 3.0 wt %, Ni: 6.0–10.0 wt %, Cr: 15.0–19.0 wt %, Cu: 1.0–4.0 wt %, Al: 0.2–2.5 wt %, N: not more than 0.05 wt %, and the balance being iron and inevitable impurities, in which Ni equivalent (wt %) represented by the following equation is adjusted to a range of 21.0–22.5 and a crystal grain size number (N) is not less than 8

$$\text{Ni equivalent (wt \%)}=12.6(C+N)+0.35Si+1.05Mn+Ni+0.65Cr+0.6Cu-0.4Al.$$

6. An austenitic stainless steel according to claim 5, wherein said steel further contains B: 0.0010–0.020 wt %.

7. An austenitic stainless steel for press forming comprising C: 0.01–0.10 wt %, Si: not more than 1.0 wt %, Mn: not more than 3.0 wt %, Ni: 6.0–10.0 wt %, Cr: 15.0–19.0 wt %, Cu: 1.0–4.0 wt %, Al: 0.2–2.5 wt %, N: not more than 0.05 wt %, O: controlled to not more than 20 ppm, S: controlled to not more than 20 ppm, and the remainder being substantially Fe, in which Ni equivalent (wt %) represented by the following equation is within a range of 21.0–23.0 and a cleanness is not more than 0.020%

$$\text{Ni equivalent (wt \%)}=12.6(C+N)+0.35Si+1.05Mn+Ni+0.65Cr+0.6Cu-0.4Al.$$

8. An austenitic stainless steel according to claim 7, wherein said steel further contains B: 0.0010–0.020 wt %.

9. An austenitic stainless steel for press forming comprising C: 0.03–0.10 wt %, Si: 0.5–1.0 wt %, Mn: not more than 3.0 wt %, Ni: 6.0–10.0 wt %, Cr: 15.0–19.0 wt %, Cu: 1.0–4.0 wt %, Al: 0.45–2.0 wt %, N: not more than 0.05 wt %, Mo: 0.05–3.0 wt % and the balance being iron and inevitable impurities, in which C and N satisfy $C+N \geqq 0.04$ wt % and Ni equivalent (wt %) represented by the following equation is within a range of not less than 21 but less than 22.8

$$\text{Ni equivalent (wt \%)}=12.6(C+N)+0.35Si+1.05Mn+Ni+0.65Cr+0.6Cu-0.4Al.$$

10. An austenitic stainless steel for press forming comprising C: 0.03–0.10 wt %, Si: 0.5–1.0 wt %, Mn: not more than 3.0 wt %, Ni: 6.0–10.0 wt %, Cr: 15.0–19.0 wt %, Cu: 1.0–4.0 wt %, Al: 0.45–2.0 wt %, N: not more than 0.05 wt %, B: 0.0010–0.020 wt % and the balance being iron and inevitable impurities, in which C and N satisfy $C+N \geqq 0.04$ wt % and Ni equivalent (wt %) represented by the following equation is within a range of not less than 21 but less than 22.8

$$\text{Ni equivalent (wt \%)}=12.6(C+N)+0.35Si+1.05Mn+Ni+0.65Cr+0.6Cu-0.4Al.$$

11. An austenitic stainless steel for press forming comprising C: 0.03–0.10 wt %, Si: less than 0.5 wt %, Mn: not more than 3.0 wt %, Ni: 6.0–10.0 wt %, Cr: 15.0–19.0 wt %, Cu: 1.0–4.0 wt %, Al: 0.5–2.0 wt %, N: not more than 0.05 wt %, Mo: 0.05–3.0 wt % and the balance being iron and inevitable impurities, in which Ni equivalent (wt %) represented by the following equation is within a range of 21.0–23.0

$$\text{Ni equivalent (wt \%)}=12.6(C+N)+0.35Si+1.05Mn+Ni+0.65Cr+0.6Cu-0.4Al.$$

12. An austenitic stainless steel for press forming comprising C: 0.03–0.10 wt %, Si: less than 0.5 wt %, Mn: not more than 3.0 wt %, Ni: 6.0–10.0 wt %, Cr: 15.0–19.0 wt %, Cu: 1.0–4.0 wt %, Al: 0.5–2.0 wt %, N: not more than 0.05 wt %, B: 0.0010–0.020 wt % and the balance being iron and inevitable impurities, in which Ni equivalent (wt %) represented by the following equation is within a range of 21.0–23.0

$$\text{Ni equivalent (wt \%)}=12.6(C+N)+0.35Si+1.05Mn+Ni+0.65Cr+0.6Cu-0.4Al.$$

13. An austenitic stainless steel for press forming comprising C: 0.03–0.10 wt %, Si: less than 0.5 wt %, Mn: not more than 3.0 wt %, Ni: 6.0–10.0 wt %, Cr: 15.0–19.0 wt %, Cu: 1.0–4.0 wt %, Al: 0.2–less than 0.5 wt %, N: not more than 0.05 wt %, Mo: 0.05–3.0 wt % and the balance being iron and inevitable impurities, in which Ni equivalent (wt %) represented by the following equation is within a range of 21.0–23.0

$$\text{Ni equivalent (wt \%)}=12.6\ (C+N)+0.35Si+1.05Mn+Ni+0.65Cr+0.6Cu-0.4Al.$$

14. An austenitic stainless steel for press forming comprising C: 0.01–0.10 wt %, Si: not more than 1.0 wt %, Mn: not more than 3.0 wt %, Ni: 6.0–10.0 wt %, Cr: 15.0–19.0 wt %, Cu: 1.0–4.0 wt %, Al: 0.2–2.5 wt %, N: not more than 0.05 wt %, Mo: 0.05–3.0 wt % and the balance being iron and inevitable impurities, in which Ni equivalent (wt %) represented by the following equation is adjusted to a range of 21.0–22.5 and a crystal grain size number (N) is not less than 8

$$\text{Ni equivalent (wt \%)}=12.6(C+N)+0.35Si+1.05Mn+Ni+0.65Cr+0.6Cu-0.4Al.$$

15. An austenitic stainless steel for press forming comprising C: 0.01–0.10 wt %, Si: not more than 1.0 wt %, Mn: not more than 3.0 wt %, Ni: 6.0–10.0 wt %, Cr: 15.0–19.0 wt %, Cu: 1.0–4.0 wt %, Al: 0.2–2.5 wt %, N: not more than 0.05 wt %, Mo: 0.03–3.0 wt %, O: controlled to not more than 20 ppm, S: controlled to not more than 20 ppm, and the remainder being substantially Fe, in which Ni equivalent (wt %) represented by the following equation is within a range of 21.0–23.0 and a cleanness is not more than 0.020%

$$\text{Ni equivalent (wt \%)}=12.6(C+N)+0.35Si+1.05Mn+Ni+0.65Cr+0.6Cu-0.4Al.$$

* * * * *